US005298375A

United States Patent [19]

Deguchi

[11] Patent Number: 5,298,375

[45] Date of Patent: Mar. 29, 1994

[54] SILVER HALIDE COLOR PHOTOGRAPHIC MATERIAL HAVING REDUCED MAGENTA COLOR STAIN

[75] Inventor: Yasuaki Deguchi, Minami-ashigara, Japan

[73] Assignee: Fuji Photo Film Co., Ltd., Kanagawa, Japan

[21] Appl. No.: 977,838

[22] Filed: Nov. 17, 1992

[30] Foreign Application Priority Data

Nov. 19, 1991 [JP] Japan ..... 3-329892

[51] Int. Cl.[5] ..... G03C 1/46

[52] U.S. Cl. ..... 430/503; 430/546; 430/558; 430/557; 430/556; 430/377

[58] Field of Search ..... 430/503, 546, 377, 557, 430/558, 556

[56] References Cited

U.S. PATENT DOCUMENTS

| | | | |
|---|---|---|---|
| 3,679,630 | 7/1972 | Corson et al. | 528/21 |
| 4,248,961 | 2/1981 | Hagen et al. | 430/381 |
| 4,289,847 | 9/1981 | Ishikawa et al. | 430/389 |
| 4,540,657 | 9/1985 | Krishnamurthy | 430/546 |
| 5,001,045 | 3/1991 | Furutachi et al. | 430/545 |

FOREIGN PATENT DOCUMENTS

| | | |
|---|---|---|
| 304067 | 2/1989 | European Pat. Off. . |
| 447969A1 | 9/1991 | European Pat. Off. . |
| 471347A1 | 2/1992 | European Pat. Off. . |
| 3-223755 | 2/1991 | Japan . |
| 3-141350 | 6/1991 | Japan . |

*Primary Examiner*—Charles L. Bowers, Jr.
*Assistant Examiner*—Geraldine Letscher
*Attorney, Agent, or Firm*—Birch, Stewart, Kolasch & Birch

[57] ABSTRACT

Disclosed is a silver halide color photographic material which contains a particular epoxy compound having slight solubility in water, an acylacetamide type yellow dye forming coupler the acyl group of which is a cyclo-alkane type and a pyrazolotriazole type magenta dye forming coupler which contains specified substituents and splitting-off group to produce color images of high keeping quality, especially to produce a yellow dye image with excellent hue and reduced discoloration upon long-range storage in the dark, and, what is more, to inhibit magenta color stain from generating in the yellow dye image.

19 Claims, No Drawings

SILVER HALIDE COLOR PHOTOGRAPHIC MATERIAL HAVING REDUCED MAGENTA COLOR STAIN

FIELD OF THE INVENTION

The present invention relates to a silver halide color photographic material which can provide excellent color reproducibility and, more particularly, to a silver halide color photographic material which contains an epoxy compound slightly soluble in water to effect an improvement in fastness of color images to light, heat and moisture and a reduction of magenta color stain upon long-range storage.

BACKGROUND OF THE INVENTION

In semipermanently storing color photographic materials as image recorded matter, it is required of them to hold color balance among three colors, namely yellow, magenta and cyan colors, of dye images even after they have undergone discoloration by preventing as greatly as possible the dye images from causing discoloration in the light (light discoloration) and that in the dark (dark discoloration) to maintain their initial color balance. However, yellow, magenta and cyan dye images are different from one another in extent of discoloration in the light and in the dark, and so color balance among the three colors is broken through imbalance of discoloration after long-range storage to cause a disadvantage that an image quality is deteriorated. For instance, since dark discoloration under high humidity circumstances is greater in yellow and cyan dye images than in a magenta dye image, a marked break in color balance occurred occasionally. When stored under the foregoing circumstances, it further occurred sometimes that molds and the like propagate themselves over the surface of a photographic material to cause marked deterioration of yellow images and, in case of color prints, to generate red spots in an image area.

For the purpose of solving the foregoing problems, using cyclic ether compounds or epoxy group-containing compounds is disclosed with respect to cyan dye images in JP-B-58-45017 (the term "JP-B" as used herein means an "examined Japanese patent publication"), JP-A-62-75447 (the term "JP-A" as used herein means an "unexamined published Japanese patent application"), JP-A-62-129853, JP-A-62-172353, JP-A-62-198859, JP-A-62-196657, JP-A-64-21447 and JP-A-64-23255, while with respect to yellow dye images, e.g., in JP-A-64-50048 and JP-A-64-50049. Concrete compounds disclosed in those patents were able to achieve some effect in improving dark discoloration, but failed to bring about a satisfactory solution. In addition, it occurred occasionally that the density of magenta color in a yellow image area was increased with a decrease of the density of yellow dye image. Generation of magenta color stain as described above presented a problem that it spoiled considerably a yellow dye image, which originally possessed excellent color reproducibility. Therefore, further heightening the keeping quality of yellow images is necessary also for retaining excellent color reproducibility over a long period of time.

As for the couplers forming yellow dye images, yellow couplers of the benzoyl and pivaloyl types which contain acetanilide as basic skeleton are known generally. In comparison with those conventional yellow couplers, the cycloalkanecarbonyl group-containing yellow couplers disclosed in EP-A-0447969 can produce yellow dye images having excellent spectral absorption characteristics and high density by the coupling reaction with the oxidation product of an aromatic primary amine developing agent. However, they are inferior to conventional yellow couplers in image keeping quality under high temperature and high humidity conditions.

As for the couplers forming magenta dye images, on the other hand, pyrazoloazole type magenta couplers are now used practically in place of pyrazolone type couplers because the images formed therefrom are superior in hue. Of such pyrazoloazole type couplers, 1H-pyrazolo[1,5-b][1,2,4]triazole type couplers disclosed in JP-A-03-141350 form magenta dye images excellent in spectral absorption characteristics, color reproducibility and fastness by the reaction with the oxidation product of an aromatic primary amine developing agent, and are appreciably reduced in a change for yellow in the white area (yellow stain) with the lapse of time. However, the magenta coupler of the above-described kind have problems of their generating magenta color stain in a yellow image area upon storage under high temperature and high humidity, particularly when used in combination with the above-cited cycloalkanecarbonyl group-containing yellow couplers.

SUMMARY OF THE INVENTION

An object of the present invention is to provide a silver halide color photographic material which can form images excellent in color reproducibility, can effect an improvement in dark discoloration of color images upon long-range storage and can provide images formed therein with excellent keeping quality. In particular, the object of the present invention consists in providing a silver halide color photographic material into which is introduced an improvement in dark discoloration of yellow dye images excellent in hue and which hardly causes magenta color stain in the yellow dye images.

As a result of our intensive studies for solving the above-described problems, it has been found that those problems can be solved effectively by using epoxy compounds of a certain kind and properly choosing substituent groups and a splitting-off group of a pyrazoloazole type magenta coupler, thereby achieving the present invention.

More specifically, the object of the present invention is effectively attained with a silver halide color photographic material comprising on a support a yellow coupler-containing light-sensitive silver halide emulsion layer, a magenta coupler-containing light-sensitive silver halide emulsion layer, a cyan coupler-containing light-sensitive silver halide emulsion layer and a light-insensitive hydrophilic colloid layer, said photographic material comprising (i) at least one epoxy compound which is slightly soluble in water and contains at least one epoxy moiety represented by the following general formula (A0), (ii) an acylacetamide type yellow coupler containing the acyl group represented by the general formula (I) and (iii) a pyrazolotriazole type magenta coupler of the general formula (II) or (III):

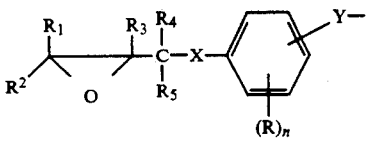

(AO)

wherein $R_1$, $R_2$, $R_3$, $R_4$ and $R_5$ are same or different, and each represents a hydrogen atom, an alkyl group or an aryl group; R represents a substituent group; n represents an integer of 0 to 4; —Y— represents a divalent linkage group; —X— represents —O—, —S— or —N(R')—; R' represents a hydrogen atom, an acyl group, an alkylsulfonyl group, an arylsulfonyl group, an aryl group, a heterocyclic group or —C($R_6$) ($R_7$) ($R_8$), wherein $R_6$, $R_7$ and $R_8$ are same or different, and each represents an alkyl group or a group represented by the following general formula (A0-1),

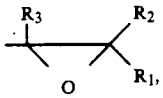

(AO-1)

and further $R_6$ and $R_7$ each may be a hydrogen atom; when n is 2, 3 or 4, R's may be same or different; and any two of $R_1$, $R_2$, $R_3$, $R_4$ and $R_5$, R' and R, or two R's may combine with each other to complete a 5- to 7-membered ring: provided that when X is —S— the total number of carbon atoms contained in said epoxy compound is at least 15, when X is —O— and Y is —$SO_2$— or a phenylene group the letter "n" is an integer of 1 to 4 or at least one of $R_1$, $R_2$, $R_3$, $R_4$ and $R_5$ is an alkyl group or an aryl group, and when X is —O— and Y is —O—$CO_2$— the total number of carbon atoms contained in $R_1$, $R_2$, $R_3$, $R_4$, $R_5$ and R is at least 10:

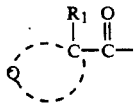

(I)

wherein $R_1$ represents a monovalent group; and Q represents nonmetallic atoms necessary to form a 3- to 5-membered hydrocarbon ring or a 3- to 5-membered hetero ring which contains at least one hetero atom selected from N, O, S and P in the ring; provided that $R_1$ is neither a hydrogen atom nor atoms completing a ring by combining with Q:

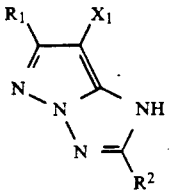

(II)

-continued

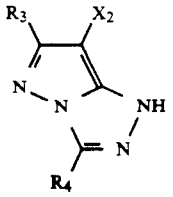

(III)

wherein $R_1$ and $R_3$ each represent an alkyl group; $R_2$ and $R_4$ each represent an alkyl group or an aryl group; and $X_1$ and $X_2$ each represent a halogen atom or an aryloxy group.

In accordance with an embodiment of the present invention, not only yellow dye image with excellent hue can be obtained but also the dye images formed have high keeping quality, that is, they suffer little from discoloration and magenta color stain upon storage under a high temperature and high humidity condition.

DETAILED DESCRIPTION OF THE INVENTION

The epoxy compounds of the present invention, which are slightly soluble in water and contain the moiety represented by the general formula (A0), are described below in detail.

The expression "epoxy compounds slightly soluble in water" as used herein refers to those having solubility of no greater than 10% in the water at 25° C., wherein the total number of carbon atoms contained is at least 9, preferably at least 18, and more preferably at least 30.

An alkyl group used in description of the general formula (A0) is intended to include straight-chain, branched and cyclic ones (e.g., methyl, ethyl, n-propyl, i-propyl, n-butyl, t-butyl, cyclohexyl, n-octyl, t-octyl, n-decyl, sec-docecyl, n-hexadecyl, n-octadecyl), which may have substituent groups.

An aryl group used in the description of the general formula (AO) is intended to include aromatic hydrocarbon residues (e.g., phenyl, naphthyl), which may have substituent groups.

A heterocyclic group used in the description of the general formula (AO) is intended to include 5- to 7-membered cyclic groups which contain oxygen, nitrogen or sulfur atom as at least one of the ring constituting atoms, which may be aromatic ones. Further, they may have substituent groups. Examples of such a heterocyclic group include thienyl, furyl, imidazolyl, pyrazolyl, pyrrolyl, indolyl, pyridyl, chromanyl, pyrazolidinyl, piperadinyl, 4-morpholinyl, triazinyl and so on.

Substituent groups used in the description of the general formula (AO) are intended to include an alkyl group, an alkenyl group, an alkinyl group, an aryl group, a heterocyclic group, an alkoxy group, an aryloxy group, an alkylthio group, an arylthio group, a hydroxyl group, a halogen atom, a cyano group, a nitro group, an acyl group, an acyloxy group, a silyloxy group, a sulfonyl group, a sulfonyloxy group, an alkoxycarbonyl group, an aryloxycarbonyl group, an amido group, an imido group, a carbamoyl group, a sulfamoyl group, an ureido group, an urethane group, an aminosulfamoyl group, an amino group, an alkylamino group, an arylamino group, a heterocyclylamino group and so on.

$R_1$, $R_2$, $R_3$, $R_4$ and $R_5$ may be same or different, and each represents a hydrogen atom, an alkyl group or an aryl group. R represents a substituent group, and n represents an integer of 1 to 4. When n is from 2 to 4, R's may be same or different. —Y— represents a divalent linkage group (e.g., a single bond, —O—, —S—, —$SO_2$—, —O—$CO_2$—, —S—, an optionally substituted imino group, an optionally substituted alkylene group, an optionally substituted phenylene group, naphthylene group, a divalent heterocyclic group).

R' represents a hydrogen atom, an acyl group (e.g., acetyl, acryloyl, benzoyl), an alkylsulfonyl group (e.g., methanesulfonyl, ethanesulfonyl, dodecanesulfonyl), an arylsulfonyl group (e.g., benzenesulfonyl, toluenesulfonyl), an aryl group, a heterocyclyl group, or —$C(R_6)(R_7)(R_8)$.

The moiety represented by general formula (AO) may be bound to hydrogen atom, or attached to another moiety via any of carbon, nitrogen, sulfur or oxygen atom thereof.

Of the epoxy compounds containing the moiety represented by general formula (AO), those containing at least 3, preferably at least 4, and more preferably at least 5, epoxy moieties represented by the general formula (AO) are desirable with respect to the effects of the present invention. In addition, it is prefeable that the epoxy compound contains at least 2, more preferably at least 3, and furthermore preferably at least 4, benzene rings in all.

In a class consisting of the present epoxy compounds which contain the epoxy moieties represented by general formula (AO), those represented by the following general formulae (AE-1) (AE-2), (AE-3) and (AE-4) are preferred over others.

(AE-1)

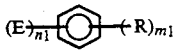

(AE-2)

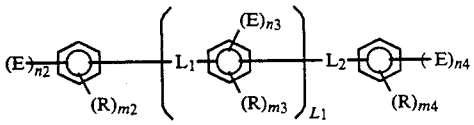

(AE-3)

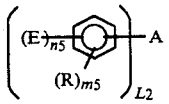

(AE-4)

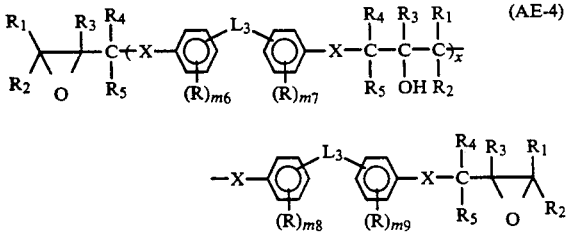

In the above formulae (AE-1), (AE-2), (AE-3) and (AE-4), E represents the following general formula (AO-2).

(AO-2)

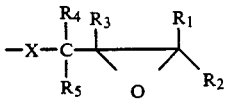

Groups from $R_1$ to $R_5$ and X in the above formula (AO-2) have the same meanings as those defined in general formula (AO) respectively.

R in the general formulae from (AE-1) to (AE-4) represents the groups as defined in general formula (AO). $L_1$, $L_2$ and $L_3$ may be the same or different, and each represents a divalent linkage group. Examples of a linkage group preferred as $L_1$, $L_2$ and $L_3$ include optionally substituted alkylene groups, such as those having the following structural formulae, respectively:

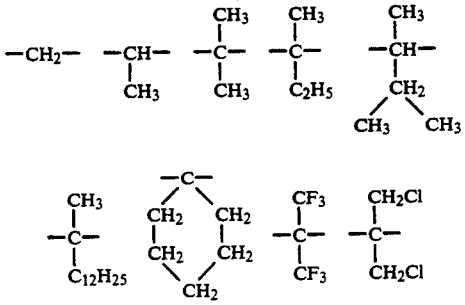

$n_1$ represents an integer of 3 to 6, $m_1$ an integer of 0 to 3, $n_2$ an integer of 1 to 5, $n_3$ an integer of 1 to 4, $n_4$ an integer of 1 to 5, $m_2$ an integer of 0 to 4, $m_3$ an integer of 0 to 3, $m_4$ an integer of 0 to 4, $n_5$ an integer of 1 to 5, $m_5$ an integer of 0 to 4, and $m_6$ to $m_9$ each an integer of 0 to 4. $l_1$ and x each represent a real number from 0 to 20. $l_2$ represents an integer 3 or 4, and A represents a tri- or tetravalent organic group. Examples of the organic group represented by A include those having the following structural formulae, respectively:

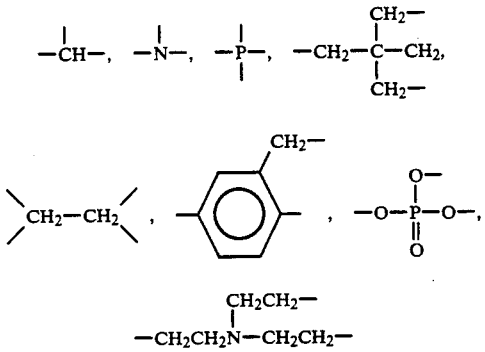

When the foregoing epoxy compounds each have a plurality of E's or/and a plurality of R's, those E's may be the same or different and those R's also may be the same or different.

Those represented by general formula (AE-2) may include mixtures of those differing in value of $l_1$ alone, and those represented by the general formula (AE-3) may also include mixtures of those differing in value of $l_2$ alone.

Of the compounds represented by general formulae from (AE-1) to (AE-4), those represented by general formulae from (AE-1) to to (AE-3) are preferable to those represented by general formula (AE-4), those represented by general formulae (AE-2) and (AE-3) are more preferable, and those represented by general formula (AE-2) are especially favored.

As for the compounds represented by general formula (AE-2), it is desirable that E is represented by general formula (AO-2), —X— is —0—, $l_1$ ranges from 1 to 20, preferably from 2 to 20, more preferably from 3 to 20 and particularly preferably from 4 to 20, $n_2$, $n_3$ and $n_4$ each is 1 or 2, $m_2$, $m_3$ and $m_4$ each is 0, 1, 2 or 3, preferably 1 or 2, and R is an alkyl group, a halogen atom or an alkoxy group.

Specific examples of the epoxy compounds of the present invention are illustrated below, but the invention should not be construed as being limited to these examples.

(A-1)

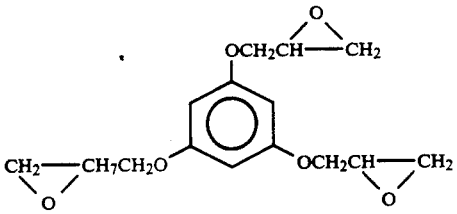

(A-2)

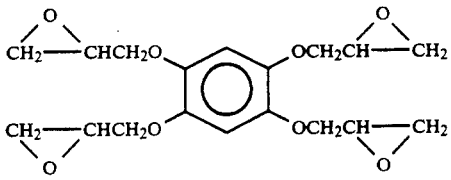

(A-3)

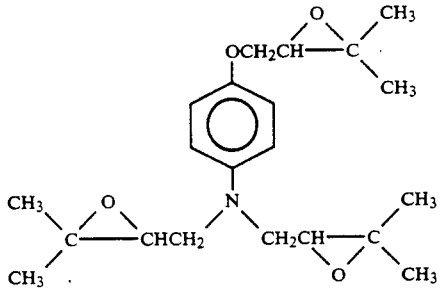

(A-4)

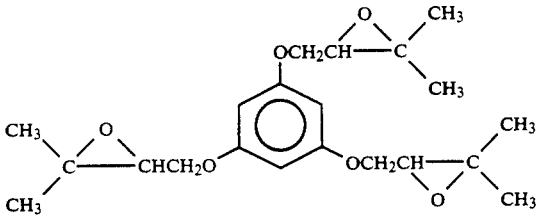

(A-5)

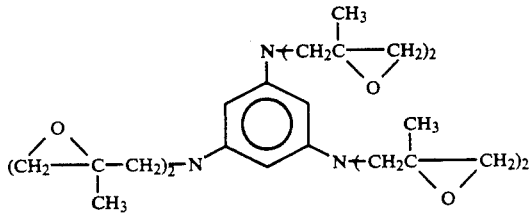

(A-6)

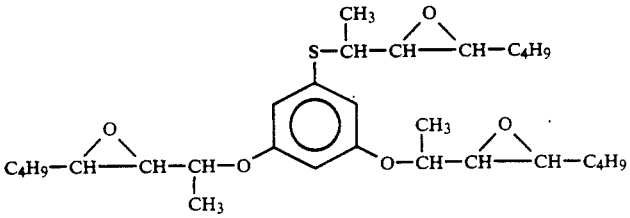

-continued
(A-7)
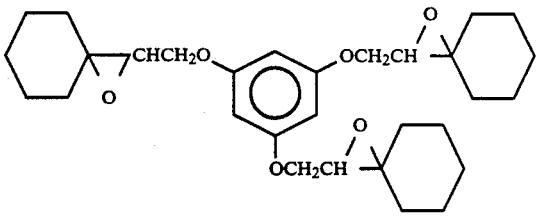
(A-8)
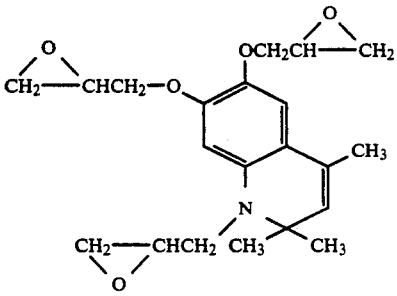
(A-9)
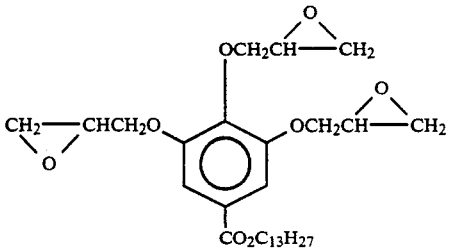
(A-10)
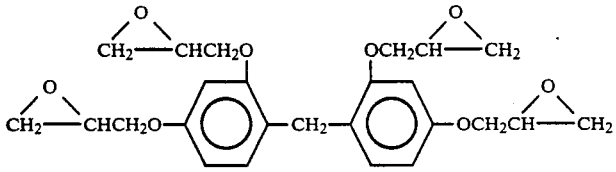
(A-11)
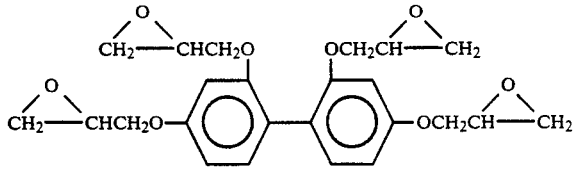
(A-12)
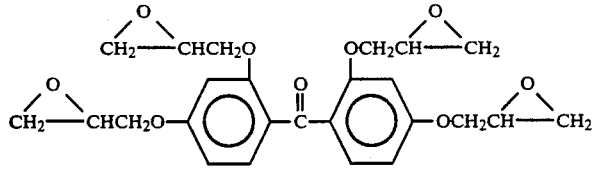
(A-13)
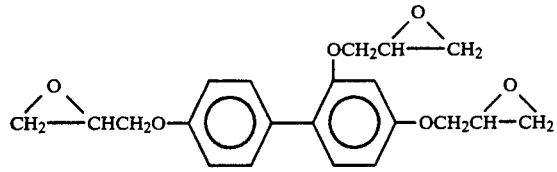
(A-14)
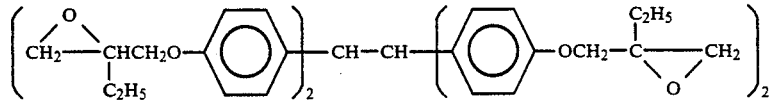

-continued
(A-15)
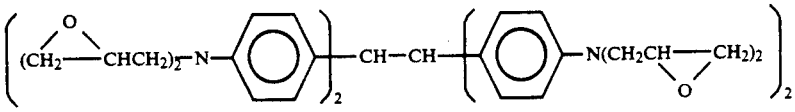
(A-16)
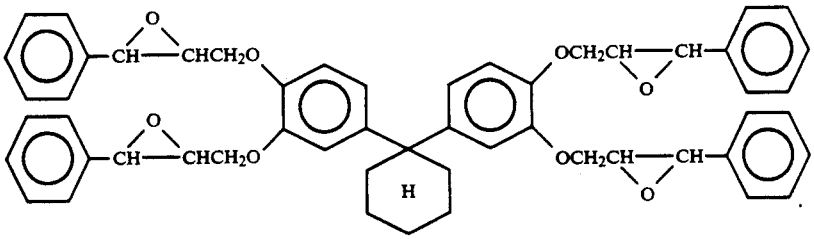
(A-17)
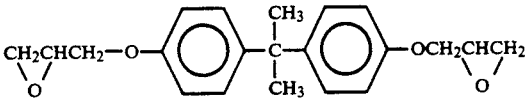
(A-18)
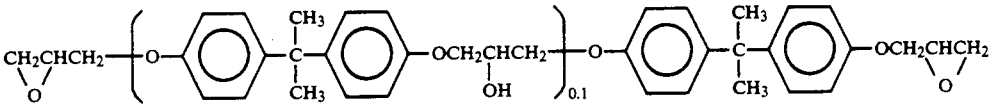
(A-19)
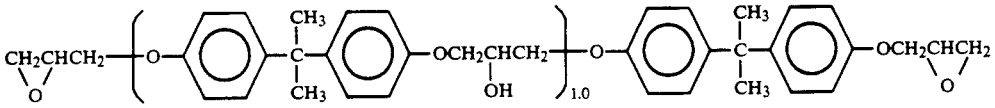
(A-20)
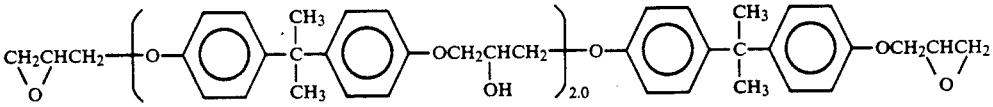
(A-21)
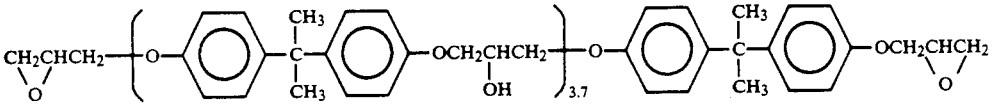
(A-22)
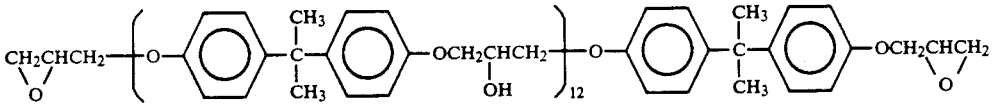
(A-23)
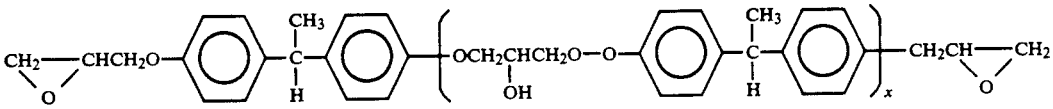
(A-24)
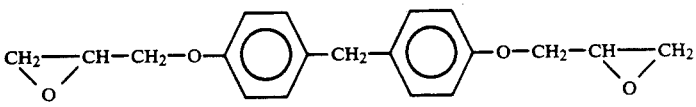
(A-25)
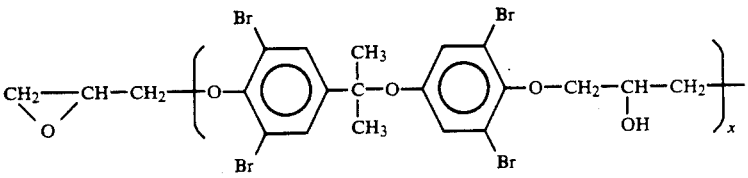

-continued
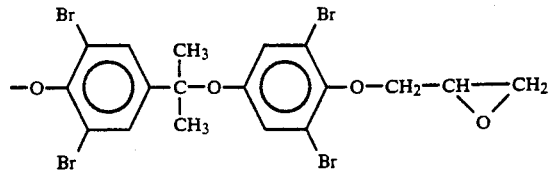
(A-26)
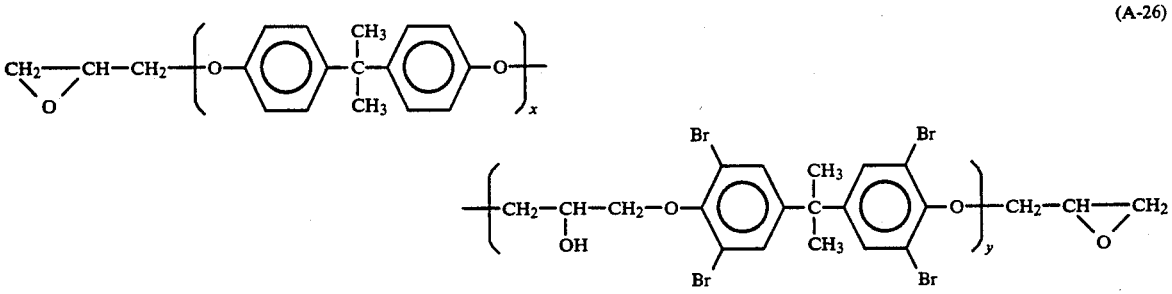
(A-27)
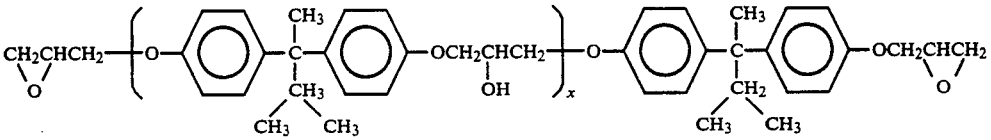
(A-28)
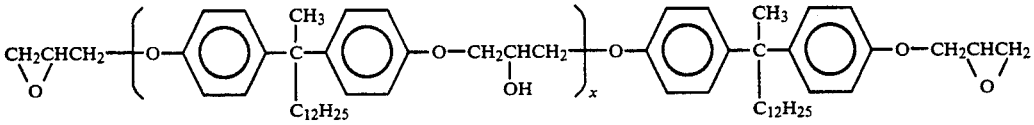
(A-29)
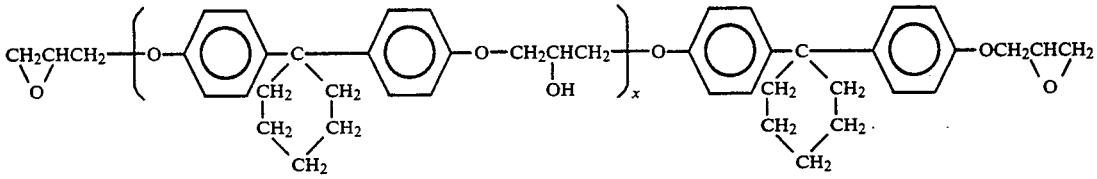
(A-30)
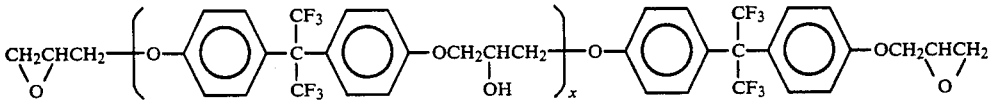
(A-31)
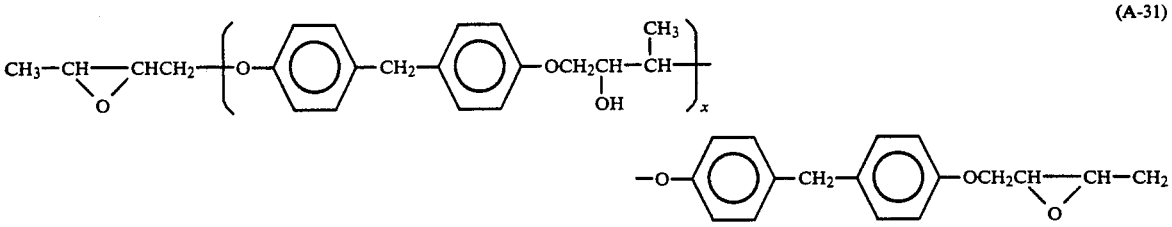
(A-32)
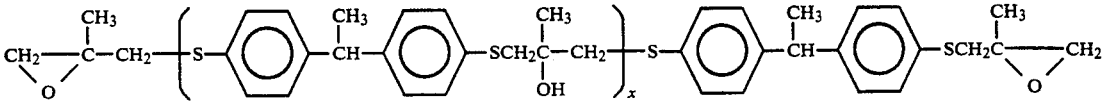
(A-33)
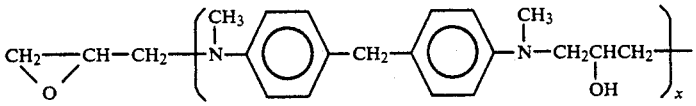

-continued
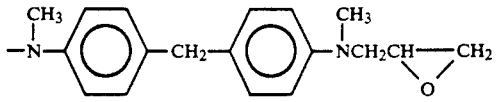
(A-34)
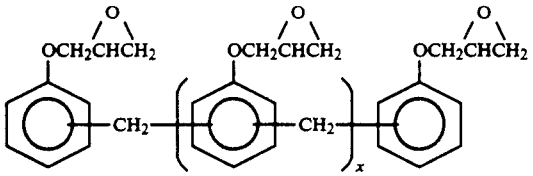
(A-35)
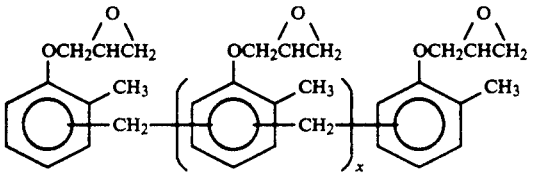
(A-36)
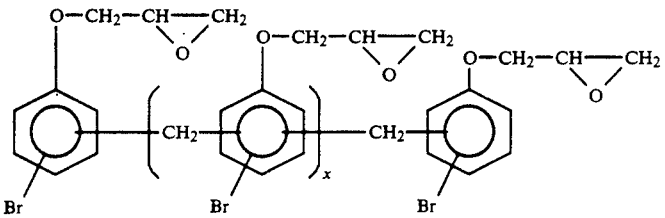
(A-37)
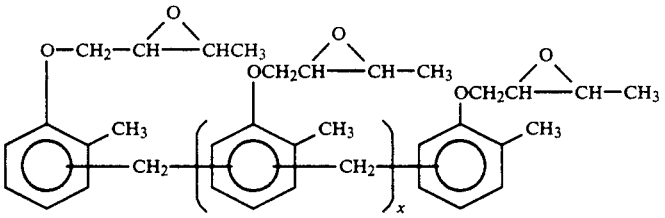
(A-38)
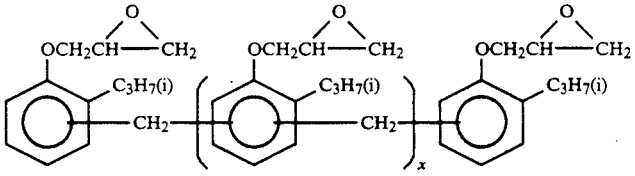
(A-39)
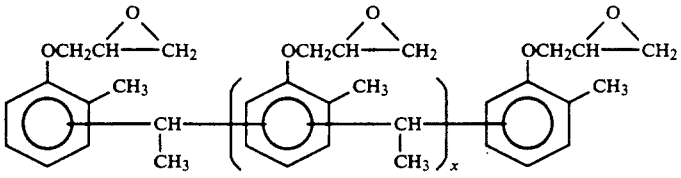
(A-40)
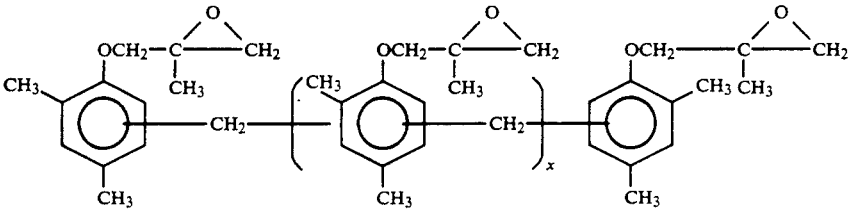

-continued
(A-41)
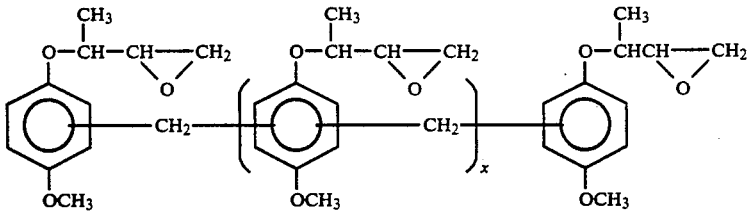
(A-42)
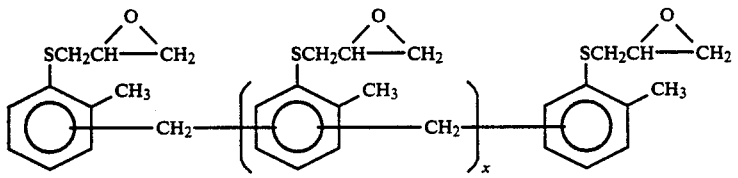
(A-43)
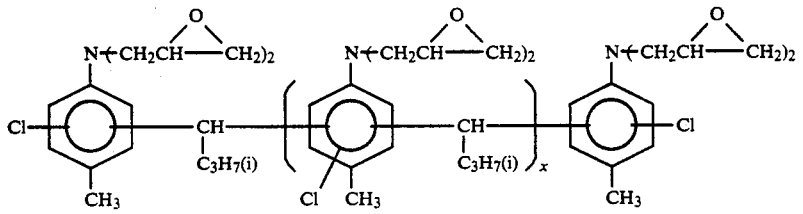
(A-44)
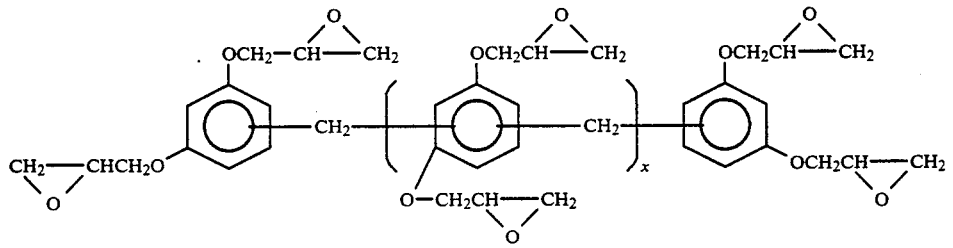
(A-45)
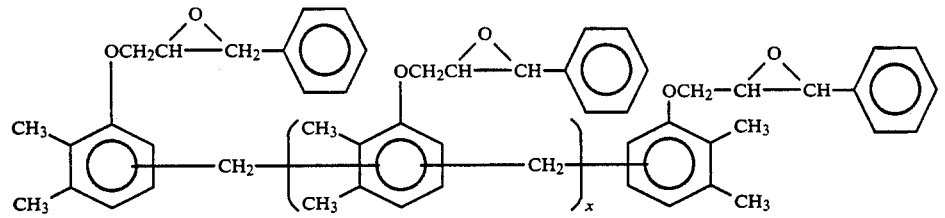
(A-46)
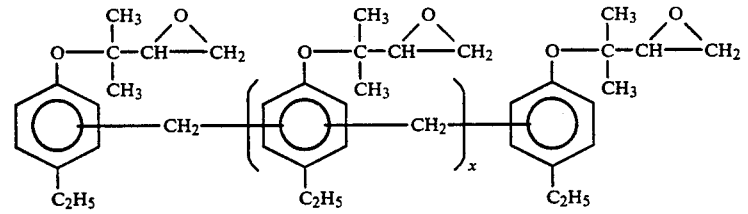
(A-47)
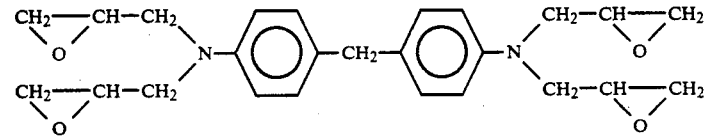

-continued (A-48)

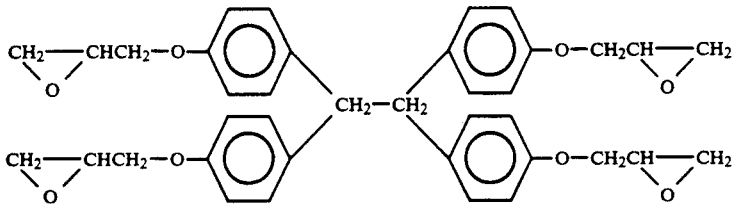

(A-49)

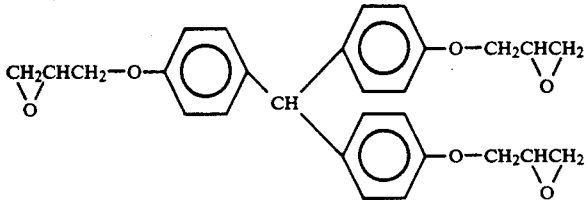

(A-50)

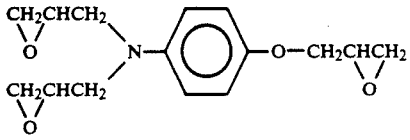

Additionally, variables x and y in the foregoing structural formulae are each a real number, and they each may be any one as far as it ranges from 0 to 20. The reason for x and y each being not necessarily an integer is that since several epoxy compounds having, respectively, different integral numbers of constitutional repeating units are present in a condition of their being mixed in a certain ratio, x and y each represent a mean value of those integral numbers. These epoxy compounds may be used individually or in combination of two or more thereof.

It is desirable that the epoxy compounds of the present invention is incorporated in a yellow coupler containing layer, a magenta coupler containing layer or an interlayer disposed therebetween, especially in a yellow coupler containing layer.

The epoxy compounds of the present invention can be used in the form of emulsified dispersion prepared by dispersing them into a hydrophilic binder, such as a water solution of gelatin, with the aid of a surfactant. The present epoxy compounds themselves may be used as high boiling organic solvent, while they may be used together with other conventional high boiling organic solvents which are slightly soluble in water and have a boiling point of no lower than 160° C., auxiliary organic solvents having a low boiling point or/and polymers soluble in both water and an organic solvent. In dispersing the present epoxy compounds in the form of emulsion, couplers and other additives may be present together therewith. Suitable examples of high boiling organic solvents and polymers as described above include those disclosed in JP-A-64-537. On the other hand, a dispersion of the present epoxy compound(s) having slight solubility in water and a coupler dispersion may be incorporated in separate layers. However, it is preferable that the present epoxy compound(s) and a coupler are incorporated in the same layer, especially in the form of emulsified dispersion wherein individual oil droplets contain both of them.

The foregoing epoxy compounds used in the present invention can be obtained, e.g., by allowing bisphenol A to react with epichlorohydrin in the presence of sodium hydroxide (for details of such a reaction a book entitled "Lectures on Plastic Materials (5) Epoxy Resins", written by Naoshiro Oh-ishi et al., published by Nikkan Kogyo Shinbunsha, can be referred to).

The epoxy compounds of the present invention are used in a proportion of preferably 3 to 100% by weight, much preferably 5 to 30% by weight, to yellow couplers used in association therewith. The proportion range described above is also applicable to the case in which the epoxy compounds are incorporated in a layer different from one which contains the yellow couplers.

Acylacetamide type yellow couplers of the present invention are preferably represented by the following general formula [Y]:

[Y]

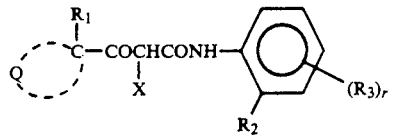

In the above formula [Y], $R_1$ and Q have the same meanings as those in general formula (I), respectively; $R_2$ represents a hydrogen atom, a halogen atom (including F, Cl, Br and I, which is the same in the subsequent description of [Y]), an alkoxy group, an aryloxy group, an alkyl group or an amino group; $R_3$ represents a group by which a hydrogen on a benzene ring may be replaced; X represents a hydrogen atom, or a group splitable by the coupling reaction with an oxidation product of an aromatic primary amine developing agent (abbreviated as a splitting-off group, hereinafter); and r represents an integer of 0 to 4. Herein, when r is a plural number, $R_3$'s may be same or different.

Examples of $R_3$ include a halogen atom, an alkyl group, an aryl group, an alkoxy group, an aryloxy group, an alkoxycarbonyl group, an aryloxycarbonyl group, a carbonamido group, a sulfonamido group, a carbamoyl group, a sulfamoyl group, an alkylsulfonyl group, an ureido group, a sulfamoylamino group, an alkoxycarbonylamino group, an aryloxysulfonyl group, an acyloxy group, a nitro group, a heterocyclic group, a cyano group, an acyl group, an acyloxy group, an alkylsulfonyloxy group and an alrylsulfonyloxy group. Examples of a splitting-off group include a heterocyclic group which is attached to the coupling active site via a nitrogen atom thereof, an aryloxy group, an arylthio group, an acyloxy group, an alkylsulfonyloxy group, an arylsulfonyloxy group, a heterocyclyloxy group and a halogen atom.

An alkyl group present as a substituent group in the general formula [Y] and an alkyl moiety contained in a substituent group present therein are intended to include straight-chain, branched and cyclic ones which may be substituted or/and may contain an unsaturated bond, provided that any particular definition is not given thereto.

When a substituent group present in the formula [Y] is an aryl group or contains an aryl moiety, the aryl group or moiety is intended to include those derived from optionally substituted monocyclic and condensed rings, provided that any particular definition is not given thereto.

When a substituent group present in the formula [Y] is a heterocyclic group or contains a heterocyclic moiety, the heterocyclic group or moiety is intended to include those derived from optionally substituted, 3- to 8-membered, monocyclic and condensed rings which contain in a ring thereof at least one hetero atom selected from O, N, S, P, Se and Te atoms, provided that any particular definition is not given thereto.

In the formula [Y], it is desirable that r is 1 or 2 and the substitution position of $R_3$ should be in the meta- or para-position to the acylacetamido group.

X in the formula [Y] preferably represents a heterocyclic group attached to the coupling active site via a nitrogen atom thereof, or an aryloxy group.

Concrete examples of groups preferably applied to X include the heterocyclic groups and aryloxy groups described in EP-A1-0447969, at pages 7, 8 and from 13 to 17.

Substituent groups which can be used to particular advantage in general formula [Y] are described below.

As for the substituent groups represented by $R_1$, alkyl groups containing 1 to 30 carbon atoms (e.g., methyl, ethyl, n-propyl, n-butyl, isobutyl, n-octyl, n-dodecyl, phenoxymethyl, phenylthiomethyl, p-toluenesulfonylmethyl, benzyl, cyclohexylmethyl, methoxyethyl) are preferred in particular. Of these groups, those containing 1 to 4 carbon atoms are most favorable.

As for the groups represented by Q, nonmetallic atoms forming a 3- to 5-membered hydrocarbon ring together with the carbon atom, such as an optionally substituted ethvlene, trimethvlene or teteramethylene group, are preferred in particular. Suitable examples of a substituent which may be present on the hydrocarbon ring formed include an alkyl group, an alkoxy group, an aryl group and a halogen atom.

A group most favorable to Q is a substituted or unsubstituted ethylene group.

As for the substituent groups represented by $R_2$, chlorine atom, fluorine atom, alkyl groups containing 1 to 6 carbon atoms (e.g., methyl, trifluoromethyl, ethyl, isopropyl, t-butyl), alkoxy groups containing 1 to 8 carbon atoms (e.g., methoxy, ethoxy, methoxyethoxy, butoxy) and aryloxy groups containing 6 to 24 carbon atoms (e.g., phenoxy, p-tolyloxy, p-methoxyphenoxy) are preferred in particular. Of these groups, chlorine atom, methoxy group and trifluoromethyl group are most favorable.

As for the substituent groups represented by $R_3$, a halogen atom, a cyano group, a trifluoromethyl group, an alkoxy group, an alkoxycarbonyl group, an aryloxycarbonyl group, a carbonamido group, a sulfonamido group, a carbamoyl group and a sulfamoyl group are preferred in particular. Of these groups, a chlorine atom, an alkoxy group, an alkoxycarbonyl group, a sulfamoyl group, a carbonamido group and a sulfonamido group are most favorable.

The couplers represented by the formula [Y] may form a dimer or a polymerized compound of higher order by no less than two molecules thereof being combined with each other via a substituent group thereof, namely $R_1$, $R_2$, $R_3$, Q or X, by the aid of a bonding hand or a divalent or a higher valent linkage group. In this case, the foregoing restrictions on the number of carbon atoms contained in each substituent group may be removed.

Specific examples of the yellow coupler represented by the formula [Y] are illustrated below.

Y-1

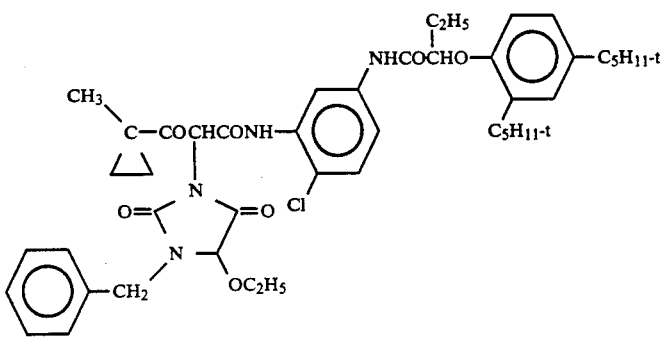

-continued
Y-2
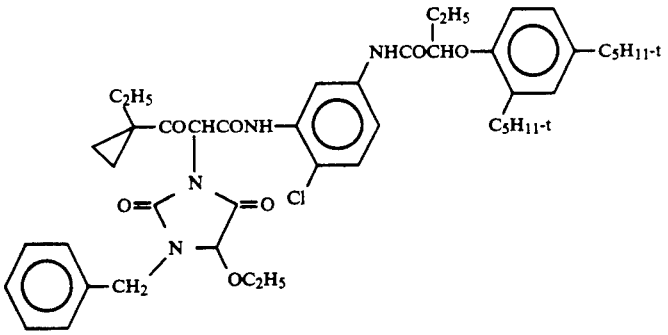
Y-3
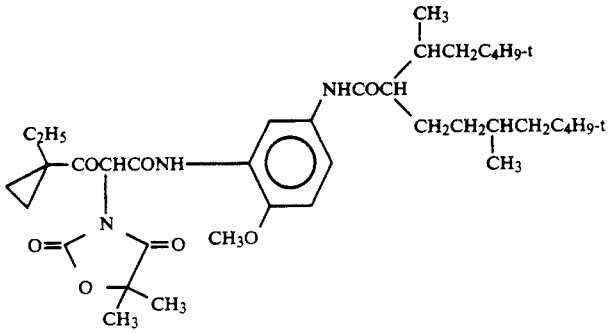
Y-4
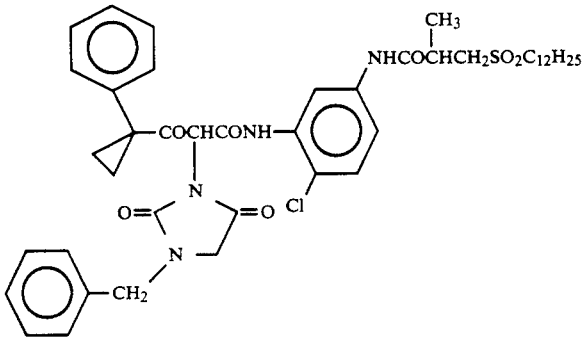
Y-5
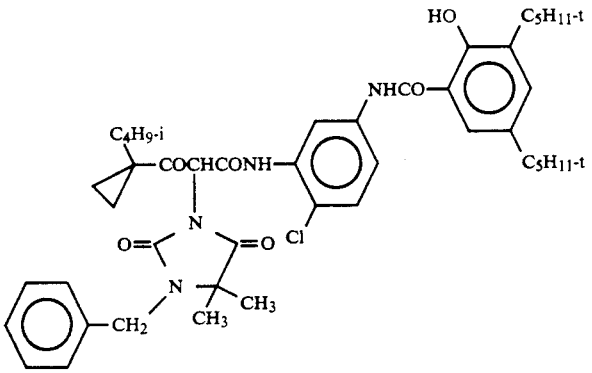

-continued
Y-6
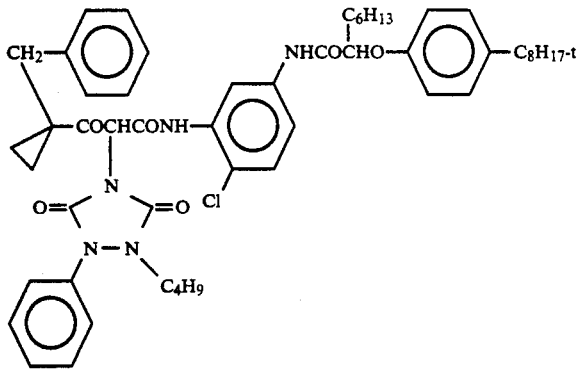
Y-7
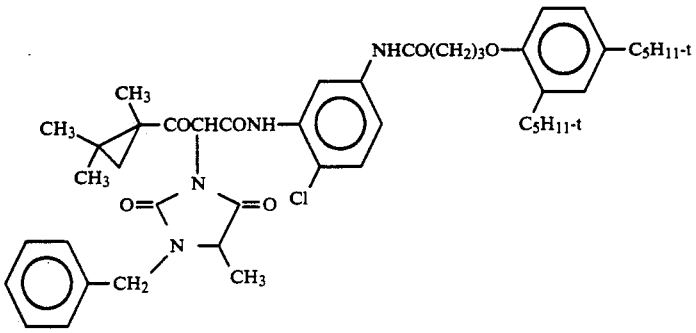
Y-8
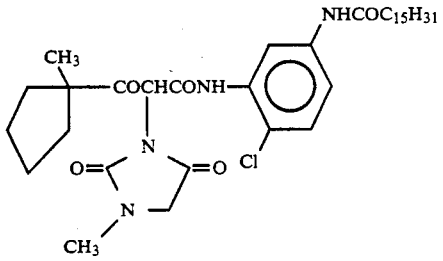
Y-9
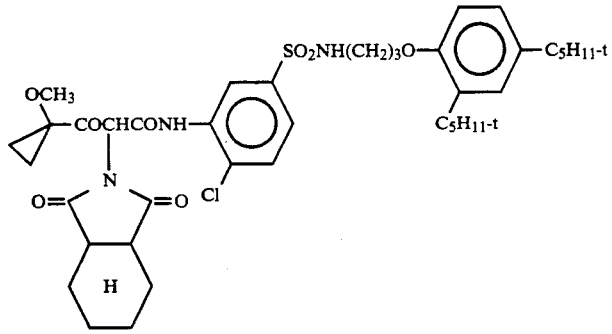
Y-10
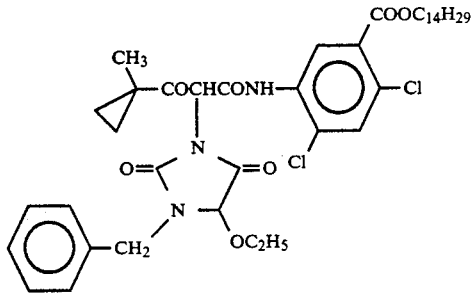

-continued
Y-11
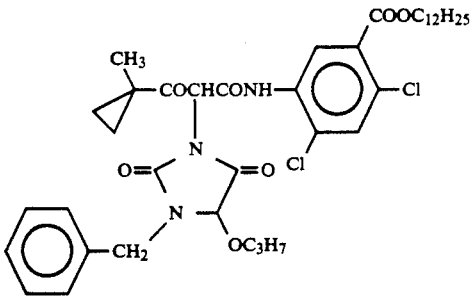
Y-12
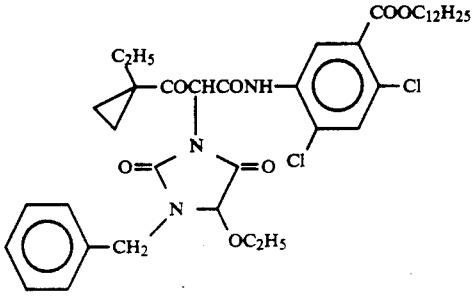
Y-13
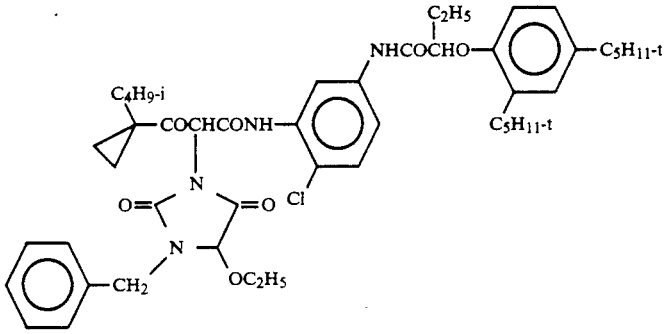
Y-14
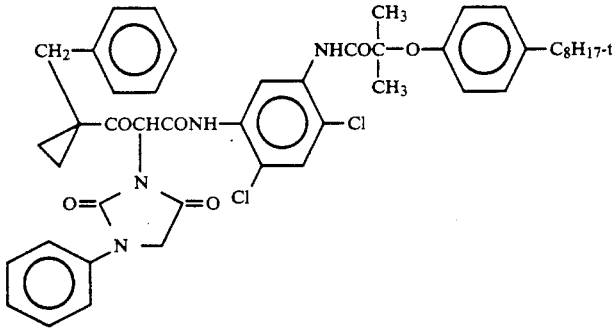
Y-15
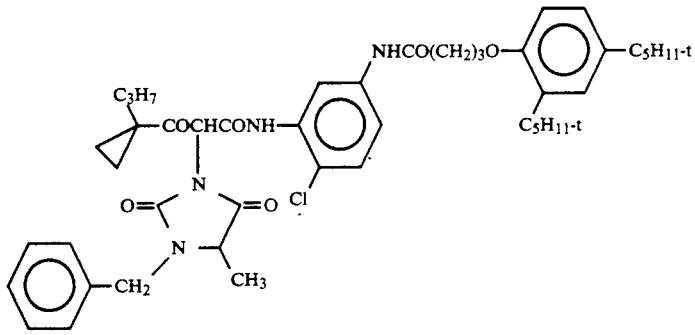

-continued
Y-16
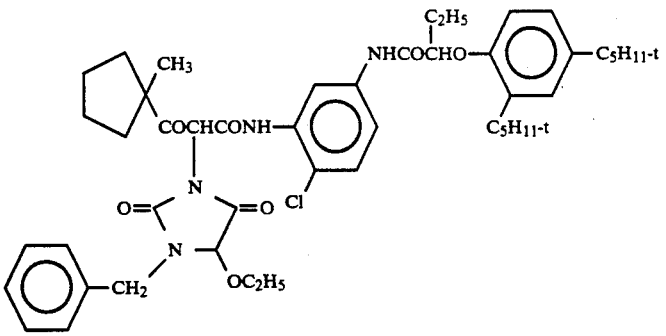
Y-17
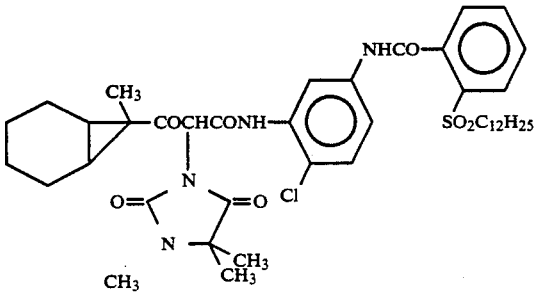
Y-18
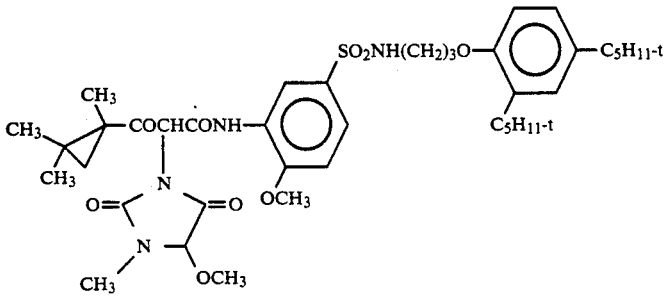
Y-19
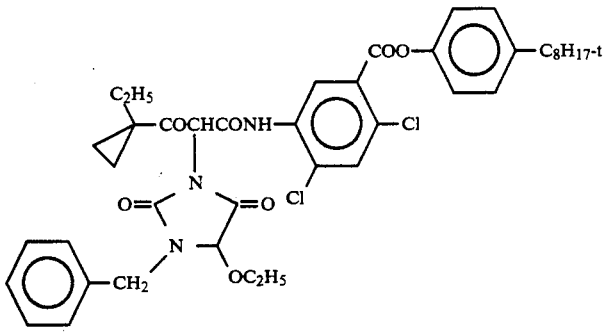
Y-20
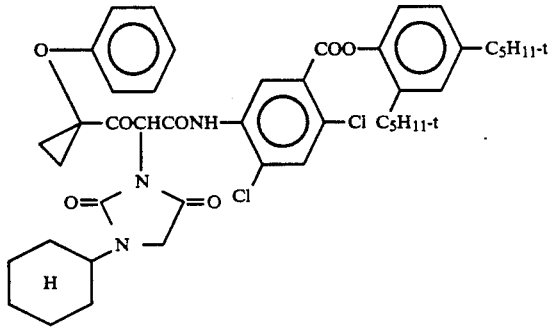

-continued
Y-21
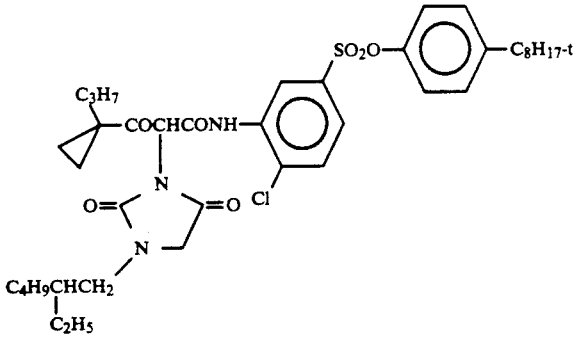
Y-22
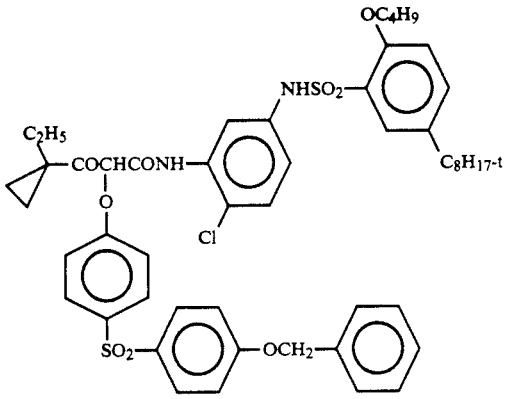
Y-23
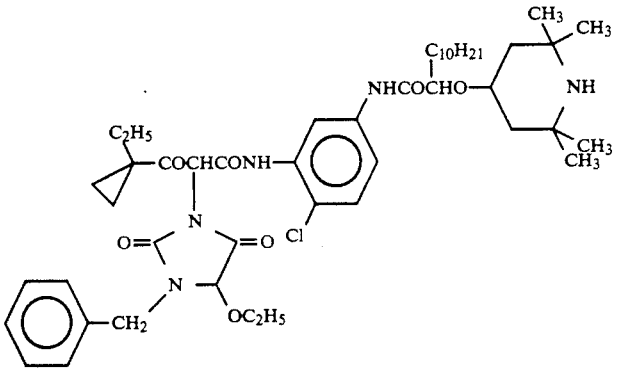
Y-24
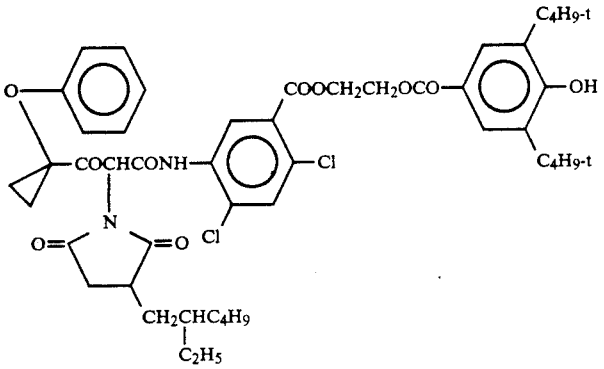

-continued
Y-25
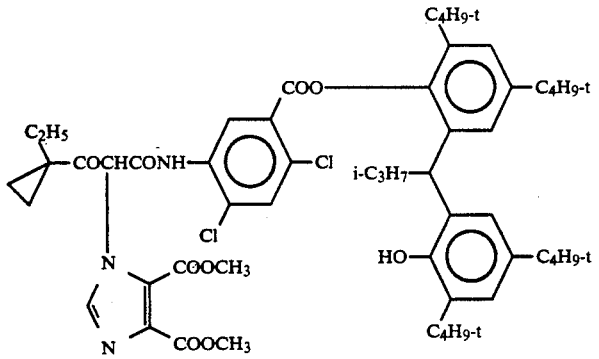
Y-26
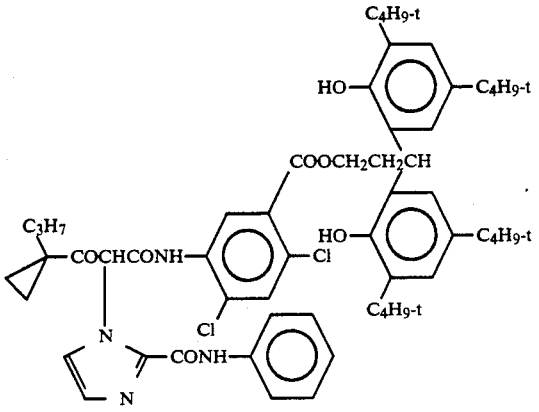
Y-27
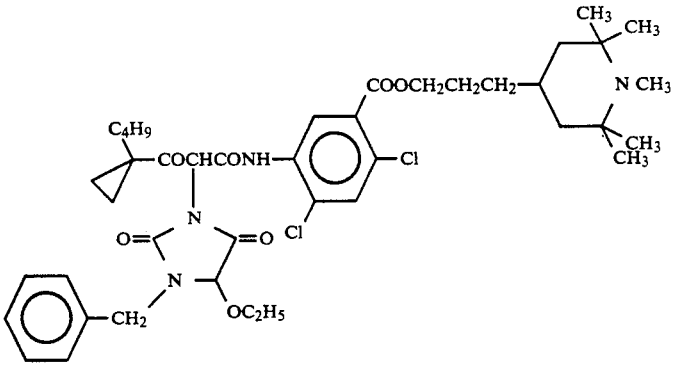
Y-28
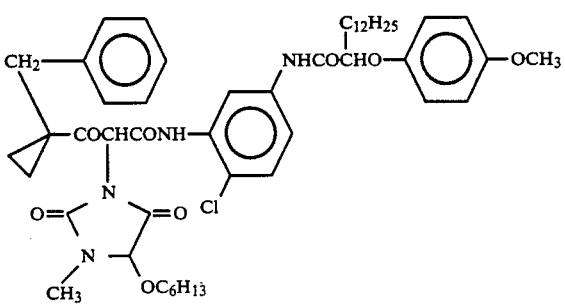

-continued
Y-29
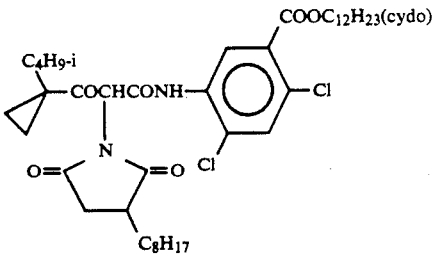
Y-30
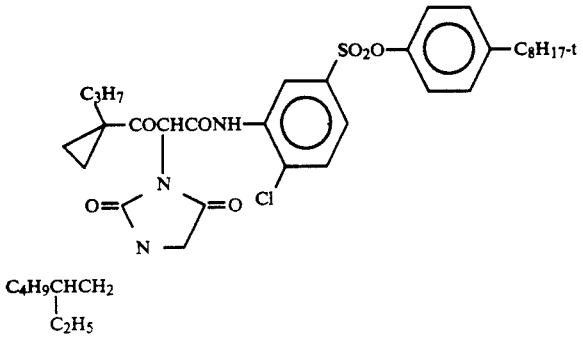
Y-31
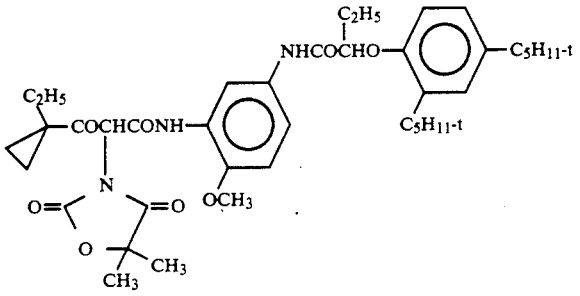
Y-32
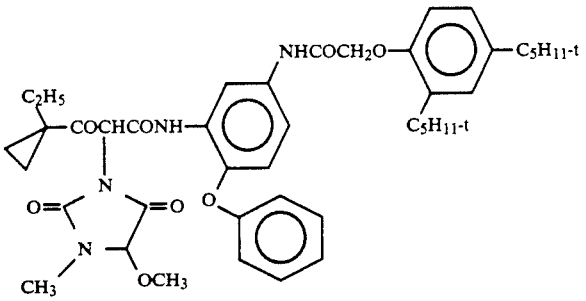
Y-33
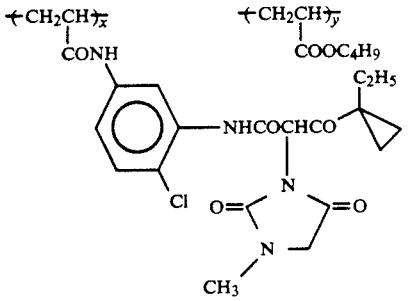
x:y = 60:40 (by weight)
number average molecular weight = 55,000

-continued

Y-34

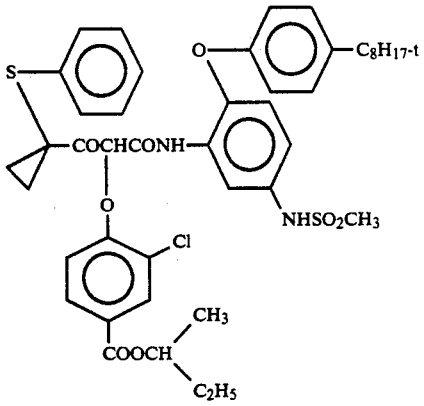

Y-35

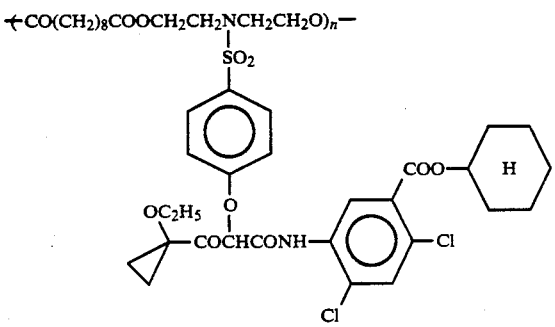

number average molecular weight = 50,000

Y-36

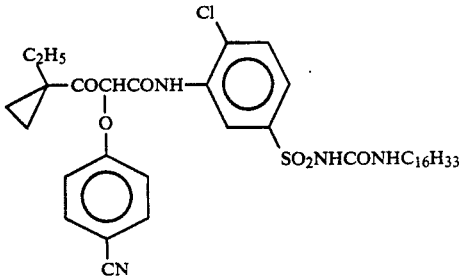

Y-37

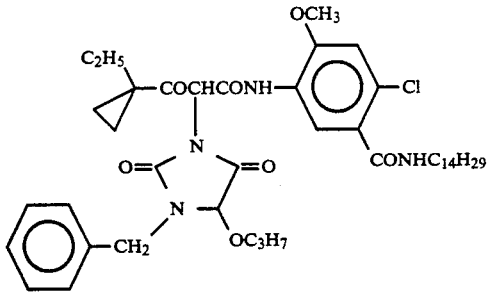

The yellow couplers represented by the formula [Y] can be prepared in accordance with known synthesis methods, e.g., those disclosed in EP-A1-0447969.

The couplers represented by formula [Y] can be used in any constituent layer the photographic material has. More specifically, they may be used in any of light-sensitive layers (including blue-sensitive, green-sensitive, red-sensitive and infrared-sensitive emulsion layers) and light-insensitive layers (such as a protective layer, a yellow filter layer, an interlayer and an antihalation layer). However, it is desirable in particular that the coupler should be used in a blue-sensitive emulsion layer or a light-insensitive layer adjacent thereto.

The coupler represented by formula [Y] is preferably used in an amount of 0.05 to 5.0 mmol, particularly 0.2 to 2.0 mmol, per square meter.

When the coupler of formula [Y] is used in a light-sensitive layer, a suitable ratio of the coupler to silver halide ranges from 1:0.1 to 1:200 by mole, preferably from 1:2 to 1:200 by mole. When the coupler is used in a light-insensitive layer, on the other hand, it is used in an amount of from 2.0 to 0.01 mole per mole of silver halide contained in the adjacent silver halide emulsion layer.

It is a matter of course that the coupler represented by formula [Y] may be used alone or together with another yellow coupler (e.g., a benzoylacetanilide type yellow coupler or a pivaloylacetanilide type yellow coupler).

A pyrazolotriazole type magenta coupler used in the present invention is represented by the foregoing general formula (II) or (III).

$R_1$, $R_2$, $R_3$, $R_4$, $X_1$ and $X_2$ present in those formulae are described below in detail.

$R_1$ and $R_3$ each represent an alkyl group. Specifically, the alkyl group includes 1-32 C substituted or unsubstituted, straight-chain, branched or cyclic ones. Of these groups, 1-10 C unsubstituted straight-chain, branched or cyclic alkyl groups are preferable. Therein, methyl, ethyl, isopropyl, t-butyl, cyclohexyl are much preferable. In particular, isopropyl and t-butyl groups are preferred over others.

$R_2$ and $R_4$ each represent an alkyl group or an aryl group. Specifically, the alkyl group includes 1-32 C substituted or unsubstituted, straight-chain, branched or cyclic ones, and the aryl group include substituted or unsubstituted phenyl groups. Those preferable as $R_2$ and $R_4$ include 1-10 C substituted or unsubstituted straight-chain or branched alkyl groups and substituted phenyl groups. A group much preferable as $R_2$ is a substituted alkyl group having one or no hydrogen atom on the carbon atom attached to the pyrazolotriazole skeleton, or a substituted phenyl group containing at least one acylamino or sulfonamido group. A group more preferable as $R_4$ is a substituted alkyl group containing at least two carbon atoms, a substituted alkyl group having one or no hydrogen atom on the carbon atom attached to the pyrazolotriazole skeleton, or a substituted phenyl group having at least one substituent at the o-position with respect to the carbon atom attached to the pyrazolotriazole skeleton.

A group especially favorable to $R_2$ is a substituted alkyl group of the formula, $-CH(CH_3)CH_2NHR_5$ or $-C(CH_3)_2CH_2NHR_5$, wherein $R_5$ represents an aliphatic or aromatic, acyl or sulfonyl group, or a substituted phenyl group having an acylamino or sulfonamido group at the m- or p-position with respect to the carbon atom attached to the pyrazolotriazole skeleton. A group especially favorable to $R_4$ is a substituted alkyl group of the formula, $-(CH_2)_n-SO_2R_6$, wherein n is an integer of at least 2 and $R_6$ represents an unsubstituted straight-chain or branched alkyl group or a substituted phenyl group, $-CH(CH_3)-NHR_7$, $-C(CH_3)_2NHR_7$, $-CH(CH_3)CH_2NHR_7$ or $-C(CH_3)_2CH_2NHR_7$, wherein $R_7$ has the same meaning as $R_5$, or a phenyl group having alkyl groups at both the o-positions with respect to the carbon atom attached to the pyrazolotriazole skeleton and further having at least one acylamino or sulfonamido group at the m- or p-position.

$X_1$ and $X_2$ each represent a halogen atom or an aryloxy group. As for the halogen atom, a chlorine atom is preferred over the others. As for the aryloxy group, substituted phenoxy groups are preferable, and those having a substituent at the p-position are more preferable. In particular, phenoxy groups having at the p-position a substituted or unsubstituted alkyl, alkoxycarbonyl or sulfonyl group are favorable to the aryloxy group.

The foregoing substituted alkyl groups and substituted phenyl groups are not particularly limited as to their respective substituents. Examples of such substituents include a halogen atom, an alkyl group, an aryl group, a heterocyclic group, cyano group, hydroxyl group, nitro group, carboxyl group, sulfo group, an amino group, an alkoxy group, an aryloxy group, an acylamino group, an alkylamino group, an anilino group, an ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclyloxy group, an azo group, an acyloxy group, a carbamoyloxy group, a silyloxy group, an aryloxycarbonylamino group, an imido group, a heterocyclylthio group, a sulfinyl group, a phosphonyl group, an aryloxycarbonyl group, an acyl group and an azolyl group.

Specific examples of the magenta couplers represented by general formulae (II) and (III) are illustrated below. However, the invention should not be construed as being limited to these examples.

TABLE 1

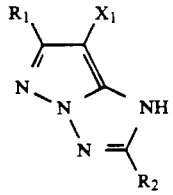

| | $R_1$ | $R_2$ | $X_1$ |
|---|---|---|---|
| M-1 | $CH_3-C(CH_3)_2-$ | $-C_6H_4-NHSO_2-C_6H_3(O-CH_2CH(C_2H_5)C_4H_9)(C_8H_{17}(t))$ | Cl |
| M-2 | " | $-C_6H_4-NHCO(C_6H_{13})CHO-C_6H_3(C_5H_{11}(t))-C_5H_{11}(t)$ | " |

TABLE 1-continued
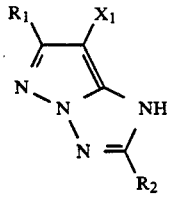
| | $R_1$ | $R_2$ | $X_1$ |
|---|---|---|---|
| M-3 | " | 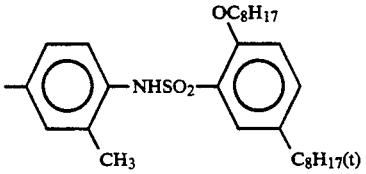 | " |
| M-4 | " | 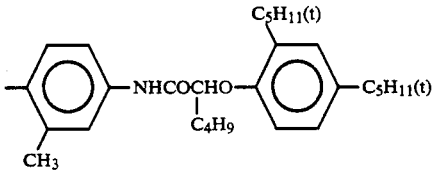 | " |
| M-5 | " | 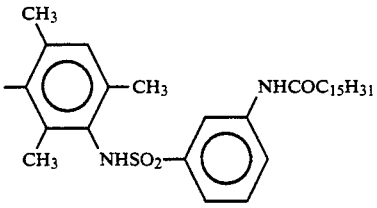 | " |
| M-6 | 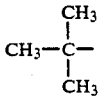 | 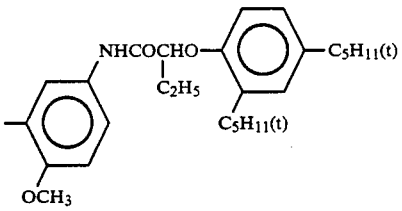 | Cl |
| M-7 | " | 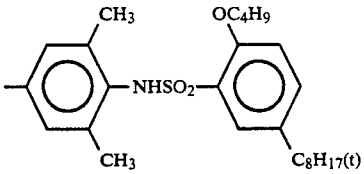 | " |
| M-8 | " | 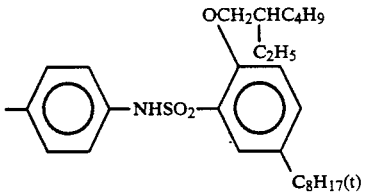 | 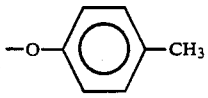 |
| M-9 | " | " | 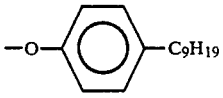 |

TABLE 1-continued
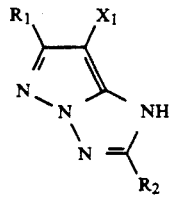
| | $R_1$ | $R_2$ | $X_1$ |
|---|---|---|---|
| M-10 | " | " | 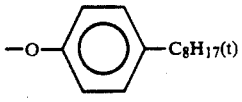 |
| M-11 | " | " | 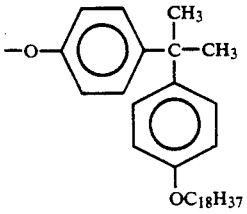 |
| M-12 | " | " | 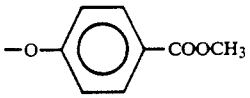 |
| M-13 | 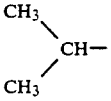 | 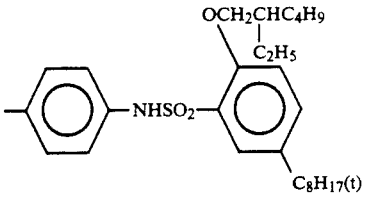 | Cl |
| M-14 | " | 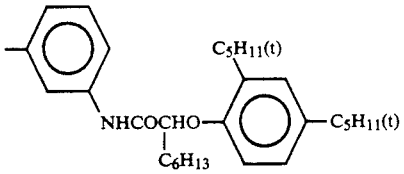 | " |
| M-15 | " | 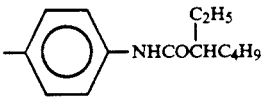 | 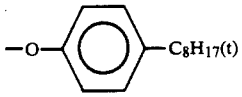 |
| M-16 | " | " | 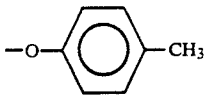 |
| M-17 | " | " | 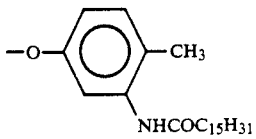 |

TABLE 1-continued
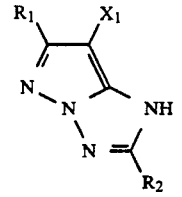
| | $R_1$ | $R_2$ | $X_1$ |
|---|---|---|---|
| M-18 | $C_2H_5$ | 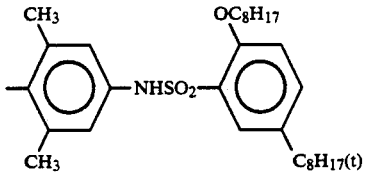 | Cl |
| M-19 | " | " | 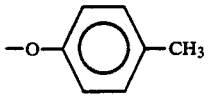 |
| M-20 | $CH_3$ | 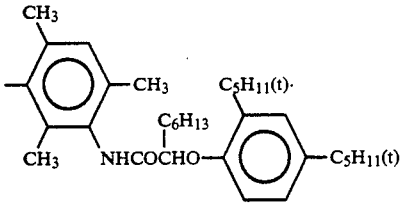 | Cl |
| M-21 | 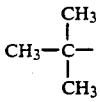 | 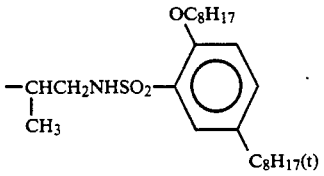 | 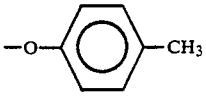 |
| M-22 | " | " | 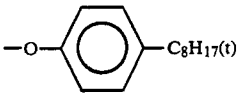 |
| M-23 | " | " | 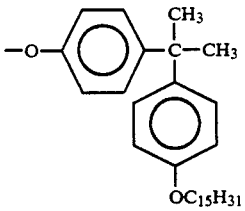 |
| M-24 | " | 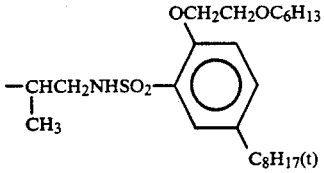 | 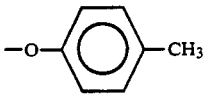 |
| M-25 | " | 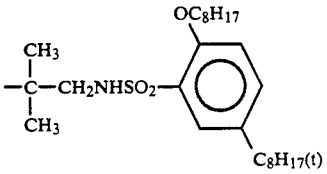 | " |

TABLE 1-continued
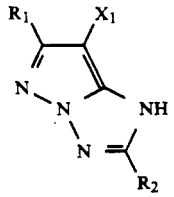
| | $R_1$ | $R_2$ | $X_1$ |
|---|---|---|---|
| M-26 | " | 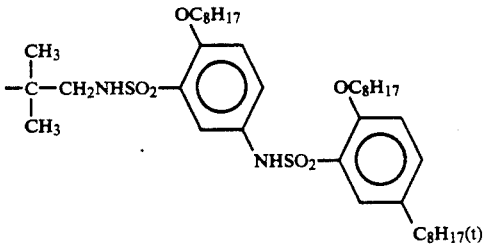 | Cl |
| M-27 | 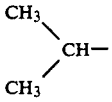 | 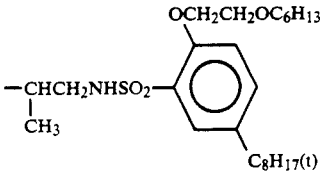 | 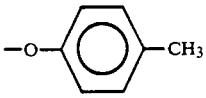 |
| M-28 | " | 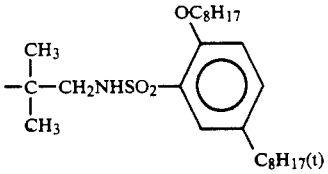 | Cl |
| M-29 | $C_2H_5$ | 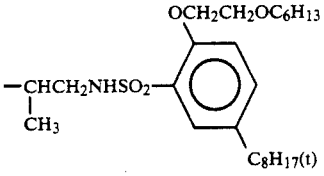 | " |
| M-30 | " | " | 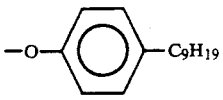 |
| M-31 | " | 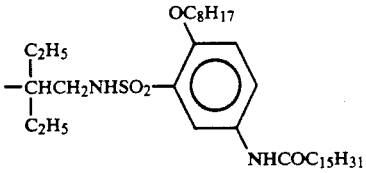 | Cl |
| M-32 | $CH_3$ | 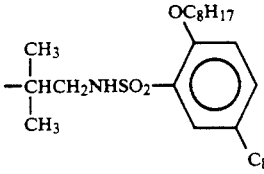 | " |

TABLE 1-continued
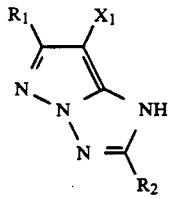
| | $R_1$ | $R_2$ | $X_1$ |
|---|---|---|---|
| M-33 | " | 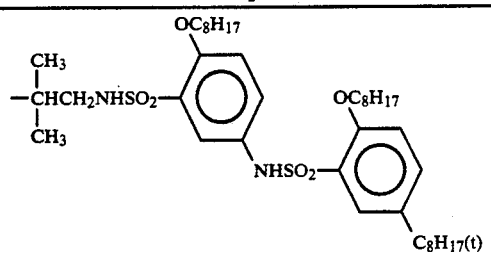 | " |

TABLE 2
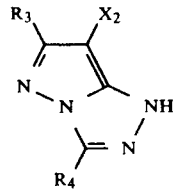
| | $R_3$ | $R_4$ | $X_2$ |
|---|---|---|---|
| m-1 | $CH_3-C(CH_3)_2-$ | $-(CH_2)_3SO_2C_{12}H_{25}$ | Cl |
| m-2 | " | $-CH(CH_3)CH_2CH_3SO_2C_{12}H_{25}$ | " |
| m-3 | " | $-C(CH_3)_2-CH_2SO_2C_{16}H_{33}$ | " |
| m-4 | " | 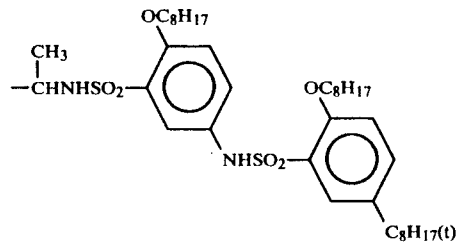 | 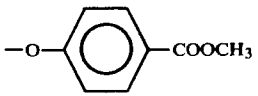 |
| m-5 | " | 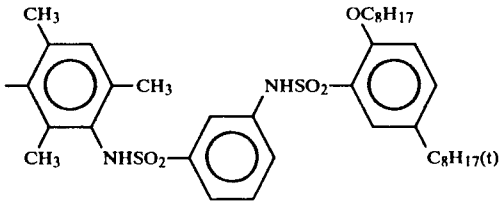 | Cl |

TABLE 2-continued
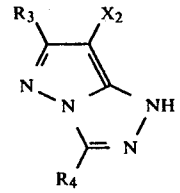
| | $R_3$ | $R_4$ | $X_2$ |
|---|---|---|---|
| m-6 | 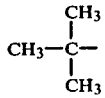 | 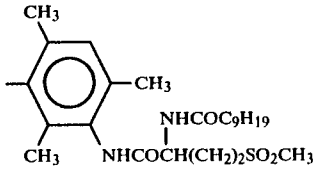 | Cl |
| m-7 | " | " | 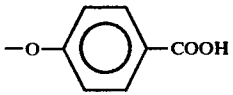 |
| m-8 | 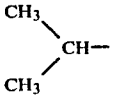 | 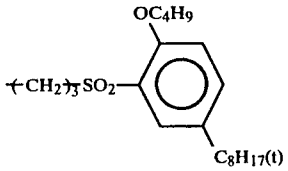 | Cl |
| m-9 | " | 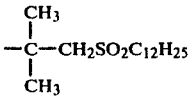 | " |
| m-10 | " | " | 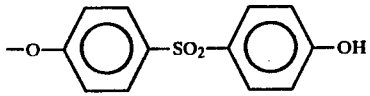 |

TABLE 2-continued
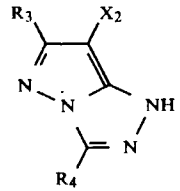
| | $R_3$ | $R_4$ | $X_2$ |
|---|---|---|---|
| m-11 | " | 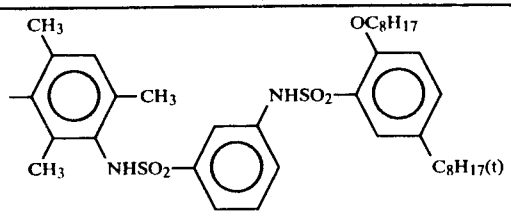 | Cl |
| m-12 | " | " | 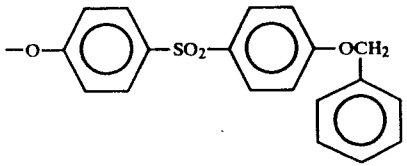 |
| m-13 | $C_2H_5$ | 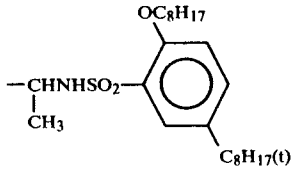 | 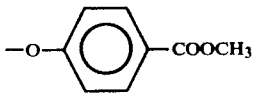 |
| m-14 | " | 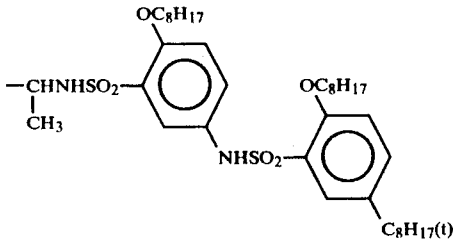 | " |

TABLE 2-continued
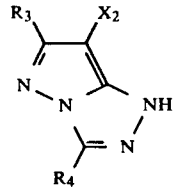
| | $R_3$ | $R_4$ | $X_2$ |
|---|---|---|---|
| m-15 | $CH_3$ | " | Cl |
| m-16 | " | 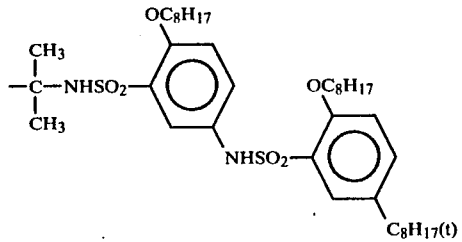 | " |
| m-17 | " | 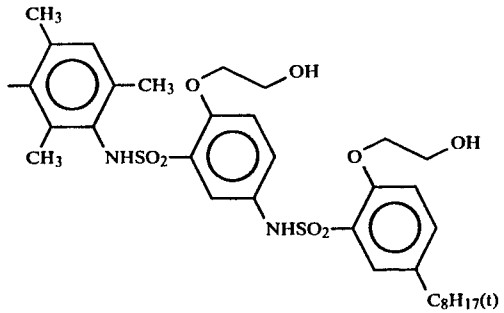 | " |
| m-18 | " | 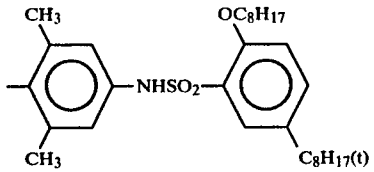 | 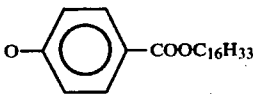 |

TABLE 2-continued
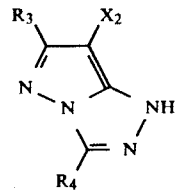
| | $R_3$ | $R_4$ | $X_2$ |
|---|---|---|---|
| m-19 | " | 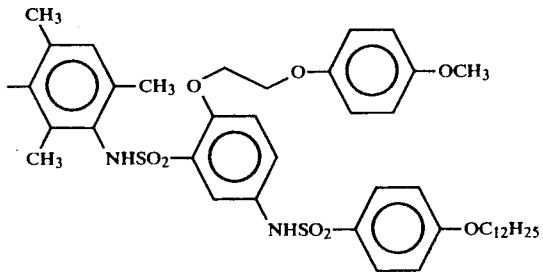 | Cl |
| m-20 | 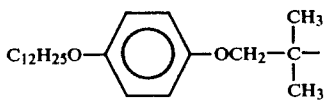 | 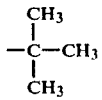 | Cl |
| m-21 | " | 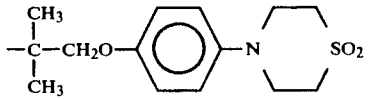 | " |
| m-22 | 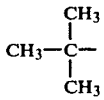 | 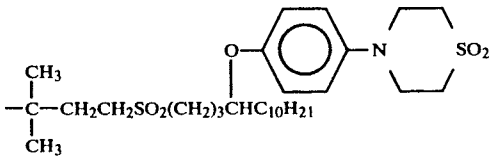 | " |

TABLE 2-continued
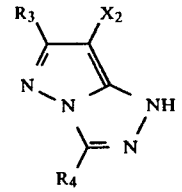
| | $R_3$ | $R_4$ | $X_2$ |
|---|---|---|---|
| m-23 | " | 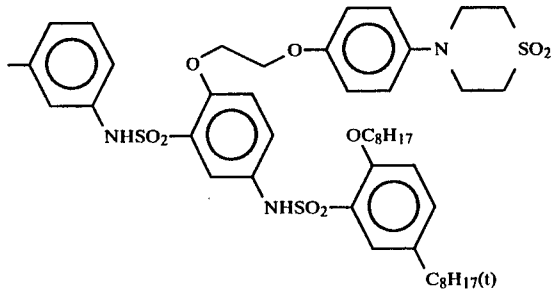 | " |
| m-24 | " | 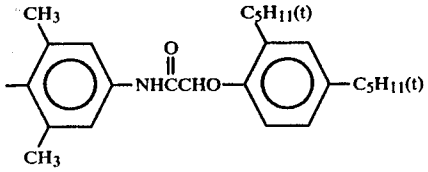 | 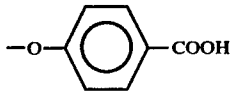 |
| m-25 | " | 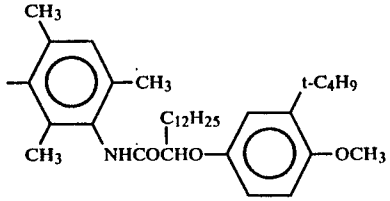 | " |
| m-26 | " | 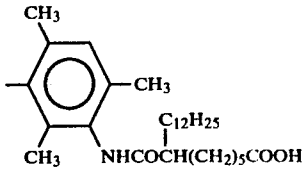 | Cl |

The compounds of the formula (II) can be synthesized using the method disclosed, e.g., in U.S. Pat. No. 4,500,630, while those of the formula (III) can be synthesized according to the methods disclosed, e.g., in U.S. Pat. Nos. 4,540,654 and 4,705,863, JP-A-61-65245, JP-A-62-209457 and JP-A-62-249155.

Silver halides which can be used in the present invention include silver chloride, silver bromide, silver (iodo)chlorobromide, silver iodobromide and so on. For the purpose of rapid processing, however, it is desirable that there are used substantially iodide-free silver chlorobromide emulsions, which have a chloride content of at least 90 mole %, preferably at least 95 mol %, particularly preferably at least 98 mol %, or silver chloride emulsions.

With the intention of making an improvement in image sharpness and the like, it is advantageous to the photographic materials relating to the present invention that dyes of the kind which can be decolored during processing, as disclosed in EP-A2-0337490, at pages 27 to 76, (especially oxonol dyes) are added to a hydrophilic colloid layer in such an amount as to give an optical reflection density of at least 0.70 at the wavelength of 680 nm to the resulting photographic materials and at least 12 wt % (preferably at least 14 wt %) of titanium oxide previously received a surface treatment with a di- to tetrahydric alcohol (e.g., trimethylol ethane) is incorporated in a waterproofing resin layer which is provided on the support.

High boiling organic solvents for photographic additives including cyan, magenta and yellow couplers which can be used in the present invention are water-immiscible compounds having a melting point of 100° C. or lower and a boiling point of 120° C. or higher. Such compounds can be used so far as they are good solvents for couplers. A preferable melting point of high boiling organic solvents is below 80° C. As for the boiling point thereof, it is preferably not lower than 160° C. and much preferably not lower than 170° C.

Details of those high boiling organic solvents are described in JP-A-62-215272, from the right lower column at page 137 to the right upper column at page 144.

A cyan, magenta or yellow coupler which is previously impregnated into a loadable latex polymer (as disclosed in U.S. Pat. No. 4,203,716) in the presence or absence of a high boiling organic solvent as described above or dissolved in a high boiling organic solvent as described above together with a polymer which is insoluble in water but soluble in an organic solvent can be dispersed into an aqueous solution of hydrophilic colloid solution in the form of emulsion.

Suitable examples of such a polymer include the homopolymers and copolymers disclosed in U.S. Pat. No. 4,857,449, in columns 7–15, and WO 88/00723, at pages 12–30. Of these polymers, methacrylate polymers and acrylamide polymers, especially acrylamide polymers, are preferred over others with respect to color image stabilization and so on.

In the photographic materials relating to the present invention, it is desirable that the compounds capable of improving the keeping quality of color images, such as those described in EP-A2-0277589, are used together with couplers, especially with the pyrazoloazole couplers.

More specifically, the combined or individual use of compounds of the kind which can produce chemically inert, substantially colorless compounds by combining chemically with an aromatic amine developing agent remaining after the color development-processing (Compounds F) and/or compounds of the kind which can produce chemically inert, substantially colorless compounds by combining chemically with an oxidized aromatic primary amine developing agent remaining after the color development-processing (Compound G) has an advantage in that the generation stains upon storage after photographic processing, which are due to the formation of dyes by the reaction between couplers and an unoxidized or oxidized color developing agent remaining in the photographic film after the photographic processing, and the occurrence of other side reactions can be prevented effectively.

For the purpose of preventing various kinds of molds and bacteria from propagating in hydrophilic colloid layers to deteriorate images, it is desirable that the antimolds disclosed in JP-A-63-271247 are added to the photographic materials relating to the present invention.

As for the support used for the photographic materials relating to the present invention, a white polyester support or a support having a white pigment-containing layer on the side of silver halide emulsion layers can be used for display. For bringing about a further improvement in sharpness, it is desirable that an antihalation layer is provided on the silver halide emulsion layer's side or the back side of the support. In particular, it is advantageous to adjust the transmission density of the support to the range of 0.20 to 2.0, preferably 0.35 to 0.8, so that the display can be observed with both transmitted light and reflected light.

The photographic materials relating to the present invention may be exposed to infrared rays as well as visible rays. As for the exposure condition, not only low illumination exposure but also high illumination momentary exposure may be adopted. To the latter case, a laser scanning exposure system in which the exposure time per picture element is shorter than $10^{-4}$ second is favorable.

In addition, it is desirable that the band stop filter disclosed in U.S. Pat. No. 4,880,726 is used in the exposure operation. This is because said filter can inhibit the generation of color stains which is caused by penetration of unnecessary rays of light into a photographic material, whereby color reproducibility can be enhanced remarkably.

The exposed photographic materials are subjected to conventional color development processing. The color development is preferably followed by bleach-fix processing for the purpose of rendering the photographic processing rapid. On the occasion that the foregoing emulsions with a high chloride content are used, it is desirable that the pH of a bleach-fix bath is adjusted to lower than about 6.5, particularly lower than about 6, for the purpose of accelerating the desilvering step.

Moreover, adoption of the processing methods disclosed in JP-A-02-207250, from left upper column at page 27 to right upper column at page 34, is favorable to the silver halide photographic materials comprising silver halide emulsions with a high chloride content of at least 90 mol %.

As suitable examples of silver halide emulsions, other ingredients (such as additives, etc.) and photographic constituent layers (including their order of arrangement), which can be applied to the photographic materials relating to the present invention, and as suitable examples of processing methods and additives for processing solutions which can be used in processing the photographic materials relating to the present invention, mention may be made of those described in the following patent specifications, especially EP-A2-0355660 (corresponding to JP-A-02-139544).

TABLE 3

| Photographic Constituents and Related Matters | JP-A-62-215272 | JP-A-02-33144 | EP-A2-0355660 |
|---|---|---|---|
| Silver halide emulsions | from 6th line in right upper column at page 10 to 5th line in left lower column at page 12, and from 4th line from the bottom of right lower column at page 12 to 17th line in left upper column at page 13 | from 16th line in right upper column at page 28 to 11th line in right lower column at page 29, and from 2nd line to 5th line at page 30 | from 53rd line at page 45 to 3rd line at page 47, and from 20th line to 22nd line at page 47 |
| Silver halide solvents | from 6th line to 14th line in left lower column at page 12, and from 3rd line from the bottom of left upper column at page 13 to the end line in left lower column at page 18 | — | — |
| Chemical sensitizers | from 3rd line from the bottom of left lower column to 5th line from the bottom of right lower column at page 12, and from 1st line in right lower column at page 18 to 9th line from the bottom of right upper column at page 22 | from 12th line to end line in right lower column at page 29 | from 4th line to 9th line at page 47 |
| Spectral sensitizers (including spectral sensitization methods) | from 8th line from the bottom of right upper column at page 22 to end line at page 38 | from 1st to 13th in left upper column at page 30 | from 10th line to 15th line at page 47 |
| Emulsion stabilizers | from 1st line in left upper column at page 39 to end line in right upper column at page 72 | from 14th line in left upper column to 1st line in right upper column at page 30 | from 16th line to 19th line at page 47 |
| Development accelerators | from 1st line in left lower column at page 72 to 3rd line in right upper column at page 91 | — | — |
| Color couplers (cyan, magenta and yellow couplers) | from 4th line in right upper column at page 91 to 6th line in left upper column at page 121 | from 14th line in right upper column at page 3 to end line in left upper column at page 18, and from 6th line in right upper column at page 30 to 11th line in right lower column at page 35 | from 15th line to 27th line at page 4, from 30th line at page 5 to end line at page 28, from 29th line to 31st line at page 45, and from 23rd line at page 47 to 50th line at page 63 |
| Color formation reinforcing agent | from 7th line in left upper column at page 121 to 1st line in right upper column at page 125 | — | — |
| Ultraviolet absorbents | from 2nd line in right upper column at page 125 to end line in left lower column at page 127 | from 14th line in right lower column at page 37 to 11th line in left upper column at page 38 | from 22nd line to 31st line at page 65 |
| Discoloration inhibitors (image stabilizers) | from 1st line in right lower column at page 127 to 8th line in left lower column at page 137 | from 12th line in right upper column at page 36 to 19th line in left upper column at page 37 | from 30th line at page 4 to 23rd line at page 5, from 1st line at page 29 to 25th line at page 45 from 33rd line to 40th line at page 45, and from 2nd line to 21st line at page 65 |
| High boiling and/or low boiling organic solvents | from 9th line in left lower column at page 137 to end line in right upper column at page 144 | from 14th line in right lower column at page 35 to 4th line from the bottom of left upper column at page 36 | from 1st line to 51st line at page 64 |
| Dispersion methods for photographic additives | from 1st line in left lower column at page 144 to 7th line in right upper column at page 146 | from 10th line in right lower column at page 27 to end line in left upper column at page 28, and from 12th line in right lower column at page 35 to 7th line in right upper column at page 37 | from 51st line at page 63 to 56th line at page 64 |
| Hardeners | from 8th line in right upper column at page 146 to 4th line in left lower column at page 155 | — | — |
| Procursors of developing agent | from 5th line in left lower column to 2nd line in right lower column at page 155 | — | — |
| Development inhibitor releasing compounds | from 3rd line to 9th line in right lower column at page 155 | — | — |

TABLE 3-continued

| Photographic Constituents and Related Matters | JP-A-62-215272 | JP-A-02-33144 | EP-A2-0355660 |
|---|---|---|---|
| Supports | from 19th line in right lower column at page 155 to 14th line in left upper column at page 156 | from 18th line in right upper column at page 38 to 3rd line in left upper column at page 39 | from 29th line at page 66 to 13th line at page 67 |
| Light-sensitive layer constitution | from 15th line in left upper column at page 156 to 14th line in right lower column at page 156 | from 1st line to 15th line in right upper column at page 28 | from 41st line to 52nd line at page 45 |
| Dyes | from 15th line in right lower column at page 156 to end line in right lower column at page 184 | from 12th line in left upper column to 7th line in right upper column at page 38 | from 18th line to 22nd line at page 66 |
| Color stain inhibitors | from 1st line in left upper column at page 185 to 3rd line in right lower column at page 188 | from 8th line to 11th line in right upper column at page 36 | from 57th line at page 64 to 1st line at page 65 |
| Tone modifiers | from 4th line to 8th line in right lower column at page 188 | — | — |
| Stain inhibitors | from 9th line in right lower column at page 188 to 10th line in right lower column at page 193 | from end line in left upper column to 13th line in right lower column at page 37 | from 32nd line at page 65 to 17th line at page 66 |
| Surfactants | from 1st line in left lower column at page 201 to end line in right upper column at page 210 | from 1st line in right upper column at page 18 to end line in right lower column at page 24, and from 10th line from the bottom of left lower column to 9th line in right lower column at page 27 | — |
| Fluorine-containing coupounds (antistatic agent, coating aids, lubricants, adhesion, inhibitors, etc.) | from 1st line in left lower column at page 210 to 5th line in left lower column at page 22 | from 1st line in left upper column at page 25 to 9th line in right lower column at page 27 | — |
| Binders (hydrophilic colloids) | from 6th line in left lower column at page 222 to end line in left upper column at page 225 | from 8th line to 18th line in right upper column at page 38 | from 23rd line to 28th line at page 66 |
| Thickening agent | from 1st line in right upper column at page 225 to 2nd line in right upper column at page 227 | — | — |
| Antistatic agent | from 3rd line in right upper column at page 227 to 1st line in left upper column at page 230 | — | — |
| Polymer latexes | from 2nd line in left upper column at page 230 to end line at page 239 | — | — |
| Matting agent | from 1st line in left upper column to end line in right upper column at page 240 | — | — |
| Photographic processing methods (including photographics steps, additives, and so on) | from 7th line in right upper column at page 3 to 5th line in right upper column at page 10 | from 4th line in left upper column at page 39 to end line in left upper column at page 42 | from 14th line at page 67 to 28th line at page 69 |

Note) The quoted paragraphs of JP-A-62-21527 are intended to include the contents of amendments dated March 16 in 1987 which were given in the end of the bulletin.

As for the yellow couplers, the so-called blue-shift couplers disclosed in JP-A-63-231451, JP-A-63-123047, JP-A-63-241547, JP-A-01-173499, JP-A-01-213648 and JP-A-01-250944 are preferably used as well as those cited in the above references.

As for the cyan couplers, not only diphenylimidazole type cyan couplers disclosed in JP-A-02-33144 but also 3-hydroxypyridine type cyan couplers disclosed in EP-A2-0333185 (especially one which is prepared by introducing a chlorine atom as a splitting-off group into Coupler (42) cited as a specific example to render the coupler two-equivalent, and couplers (6) and (9) cited as specific examples) and cyclic active methylene type cyan couplers disclosed in JP-A-64-32260 (especially Couplers 3, 8 and 34 cited as specific examples) are preferably used in addition to those cited in the above references.

The present invention will now be illustrated in more detail by reference to the following examples. However, the invention should not be construed as being limited to those examples.

EXAMPLE 1

A paper support laminated with polyethylene on both sides were coated with constituent layers described below to prepare a multilayer color photographic paper, Sample 1A (for comparison). Coating solutions used were prepared in the manner described below.

Preparation of Coating Solution for First Layer

A mixture of 19.1 g of an yellow coupler (ExY), 4.4 g of a color image stabilizer (Cpd-1) and 0.7 g of a color image stabilizer (Cpd-7) were dissolved in a mixture of 27.2 ml of ethyl acetate with 8.2 g of a solvent (Solv-1), and then dispersed in an emulsified condition into 185 ml of a 10% aqueous gelatin solution containing 8 ml of a 10% solution of sodium dodecylbenzenesulfonate.

On the other hand, there were prepared two kinds of silver chlorobromide emulsions, one of which had a cubic crystal shape, an average grain size of 0.88 μm and a variation coefficient of 0.08 with respect to grain size distribution, the other of which had a cubic crystal shape, an average grain size of 0.70 μm and a variation coefficient of 0.10 with respect to grain size distribution, and both of which contained 0.2 mol % of silver bromide in a condition such that the bromide was localized at the grain surface). Blue-sensitive sensitizing dyes illustrated below were each added to the emulsion of large grain size in the amount of $2.0\times10^{-4}$ mole/mole Ag and to the emulsion of small grain size in the amount of $2.5\times10^{-4}$ mole/mole Ag. Further, both of the emulsions were subjected to sulfur sensitization. Then, the large grain size emulsion and the small grain size emulsion were mixed in a ratio of 3:7 on a silver basis.

The resulting emulsion was mixed homogeneously with the foregoing emulsified dispersion, and thereto were added other ingredients described below so as to obtain the coating solution for the first layer having the composition described below.

Coating solutions for from the second to seventh layers were prepared respectively in the same manner as that for the first layer. In each layer, sodium salt of 1-oxy-3,5-dichloro-s-triazine was used as gelatin hardener. In addition, the following compounds were added to every coating solution for forming from the first to the seventh layer in order to keep it from rotting and getting moldy.

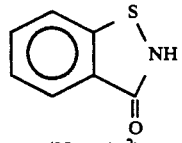
(25 mg/m²)

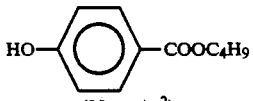
(25 mg/m²)

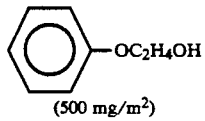
(500 mg/m²)

Spectral sensitizing dyes illustrated below were used for light-sensitive emulsion layers, respectively.

Sensitizing Dyes for Blue-Sensitive Emulsion Layer

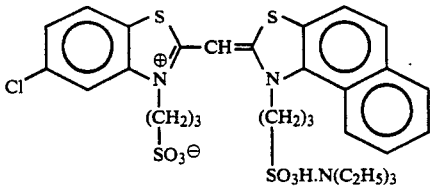

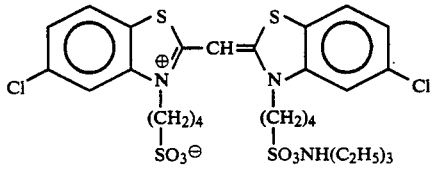

(which were each added to the emulsion of large grain size in the amount of $2.0\times10^{-4}$ mole/mole Ag and to the emulsion of small grain size in the amount of $2.5\times10^{-4}$ mole/mole Ag)

Sensitizing Dyes for Green-Sensitive Emulsion Layer

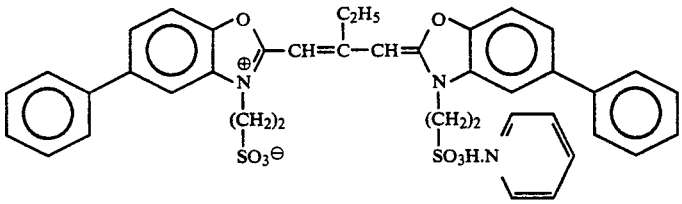

(which was added to the emulsion of large grain size in the amount of $4.0\times10^{-4}$ mole/mole Ag and to the emulsion of small grain size in the amount of $5.6\times10^{-4}$ mole/mole Ag)

and

-continued

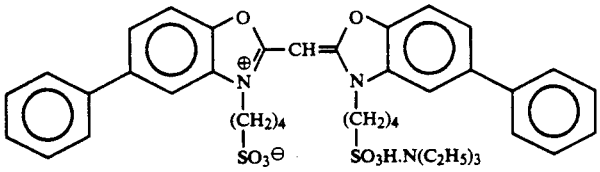

(which was added to the emulsion of large grain size in the amount of $7.0 \times 10^{-5}$ mole/mole Ag and to the emulsion of small grain size in the amount of $1.0 \times 10^{-5}$ mole/mole Ag)

Sensitizing Dye for Red-Sensitive Emulsion Layer

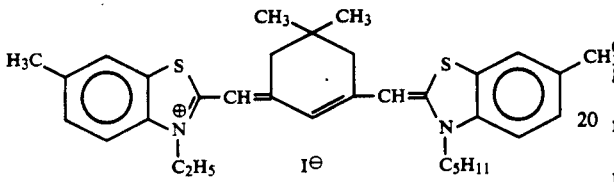

(which was added to the emulsion of large grain size in the amount of $0.9 \times 10^{-4}$ mole/mole Ag and to the emulsion of small grain size in the amount of $1.1 \times 10^{-4}$ mole/mole Ag)

To the red-sensitive emulsion layer, the compound illustrated below was further added in the amount of $2.6 \times 10^{-3}$ mole/mole Ag.

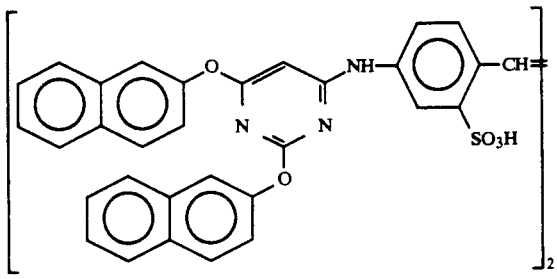

Further, 1-(5-methylureidophenyl)-5-mercaptotetrazole was incorporated into the blue-sensitive, the green-sensitive and the red-sensitive emulsion layers in the amounts of $8.5 \times 10^{-5}$ mole/mole Ag, $7.7 \times 10^{-4}$ mole/mole Ag and $2.5 \times 10^{-4}$ mole/mole Ag, respectively.

Furthermore, 4-hydroxy-6-methyl-1,3,3a,7-tetrazaindene was incorporated into the blue-sensitive and the green-sensitive emulsion layers in the amounts of $1 \times 10^{-4}$ mole/mole Ag and $2 \times 10^{-4}$ mole/mole Ag, respectively.

In addition, the following dyes were incorporated in the emulsion layers in order to prevent the irradiation phenomenon.

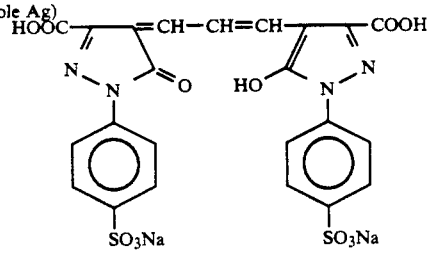

and

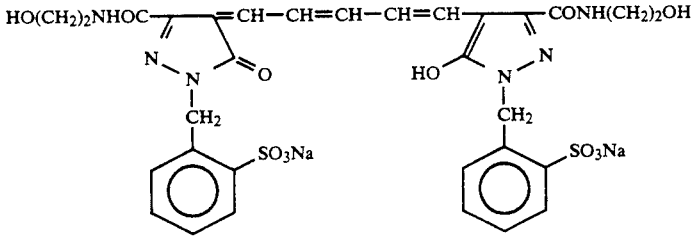

Layer Structure

The composition of each constituent layer is described below. Each figure on the right side represents the coverage ($g/m^2$) of the ingredient corresponding thereto. As for the silver halide emulsion, the figure represents the coverage based on silver.

| | |
|---|---|
| Support: | |
| Polyethylene-laminated paper which contained white pigment ($TiO_2$) and a bluish dye (ultramarine) in the polyethylene laminated on the side of the first layer | |
| First layer (blue-sensitive layer): | |
| Silver chlorobromide emulsion described above | 0.30 |
| Gelatin | 1.86 |
| Yellow Coupler (ExY) | 0.82 |
| Color image stabilizer (Cpd-1) | 0.19 |
| Solvent (Solv-1) | 0.35 |
| Color image stabilizer (Cpd-7) | 0.06 |
| Second Layer (color stain inhibiting layer): | |
| Gelatin | 0.99 |
| Color stain inhibitor (Cpd-5) | 0.08 |

-continued

| | |
|---|---|
| Solvent (Solv-1) | 0.16 |
| Solvent (Solv-4) | 0.08 |
| Third layer (green-sensitive layer): | |
| Silver chlorobromide emulsion [1:3 (by mole based on Ag) mixture of an emulsion having a cubic crystal shape, an average grain size of 0.55 μm and a variation coefficient of 0.10 with respect to size distribution and an emulsion having a cubic crystal shape, an averge grain size of 0.39 μm and a variation coefficient of 0.08 with respect to size distribution, which both contained 0.8 mol % of AgBr localized at the grain surface] | 0.12 |
| Gelatin | 1.24 |
| Magenta coupler (ExM) | 0.20 |
| Color image stabilizer (Cpd-2) | 0.03 |
| Color image stabilizer (Cpd-3) | 0.15 |
| Color image stabilizer (Cpd-4) | 0.02 |
| Color image stabilizer (Cpd-9) | 0.02 |
| Solvent (Solv-2) | 0.40 |
| Fourth layer (ultraviolet absorbing layer): | |
| Gelatin | 1.58 |
| Ultraviolet absorbent (UV-1) | 0.47 |
| Color stain inhibitor (Cpd-5) | 0.05 |
| Solvent (Solv-5) | 0.24 |
| Fifth layer (red-sensitive layer): | |
| Silver chlorobromide emulsion [1:4 (by mole based on Ag) mixture of an emulsion having a cubic crystal shape, an average grain size of 0.58 μm and a variation coefficient of 0.09 with respect to size distribution and an emulsion having a cubic crystal shape, an average grain size of 0.45 μm and a variation coefficient of 0.11 with respect to size distribution, which both contained 0.6 mol % of AgBr localized in part of the grain surface] | |
| Gelatin | 1.34 |
| Cyan coupler (ExC) | 0.32 |
| Color image stabilizer (Cpd-6) | 0.17 |
| Color image stabilizer (Cpd-7) | 0.30 |
| Color image stabilizer (Cpd-8) | 0.04 |
| Solvent (Solv-6) | 0.30 |
| Sixth layer (ultraviolet absorbing layer): | |
| Gelatin | 0.53 |
| Ultraviolet absorbent (UV-1) | 0.16 |
| Color stain inhibitor (Cpd-5) | 0.02 |
| Solvent (Solv-5) | 0.08 |
| Seventh layer (protective layer): | |
| Gelatin | 1.33 |
| Acryl-modified polyvinyl alcohol copolymer (modification degree: 17%) | 0.17 |
| Liquid paraffin | 0.03 |

The structural formulae of the compounds used herein are illustrated below:

(ExY) Yellow Coupler

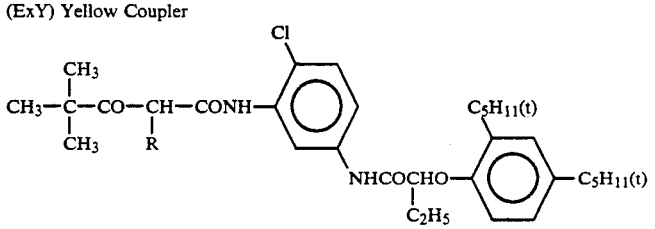

1:1 (by mole) mixture of those containing

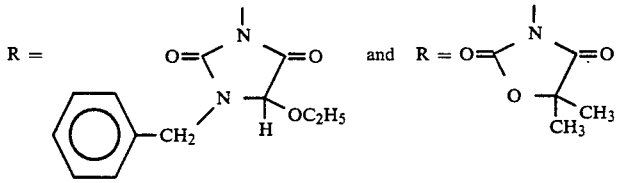

(ExM) Magenta Coupler
1:1 (by mole) mixture of (1) and (2):

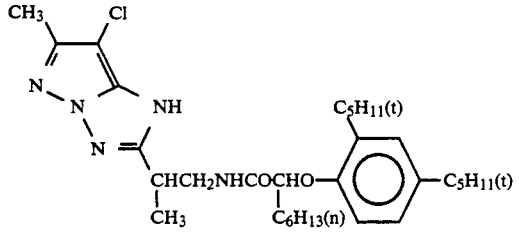

(1)

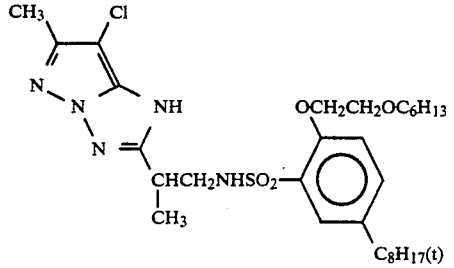

(2)

-continued
(ExC) Cyan coupler
2:4:4 (by weight) mixture of those containing R = $C_2H_5$ and R = $C_4H_9$, respectively, in the following formula,
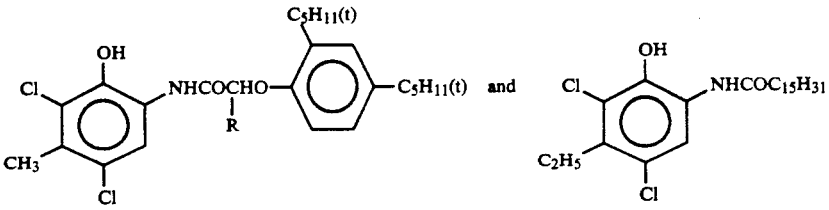
(Cpd-1) Color image stabilizer
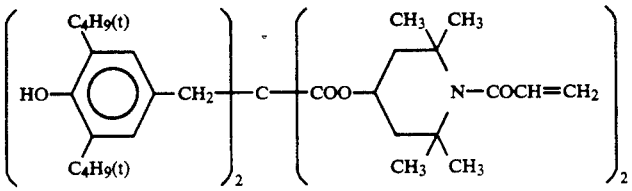
(Cpd-2) Color image stabilizer
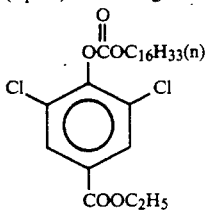
(Cpd-3) Color image stabilizer
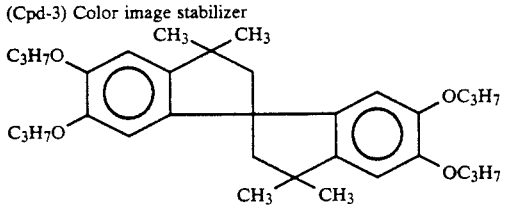
(Cpd-4) Color image stabilizer
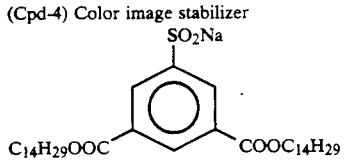
(Cpd-5) Color stain inhibitor
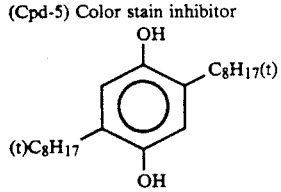
(Cpd-6) Color image stabilizer
2:4:4 (by weight) mixture of (1), (2) and (3):
(1)
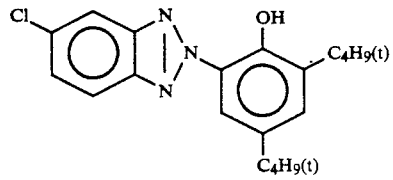

-continued
(2)
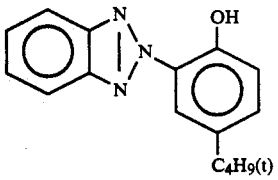
(3)
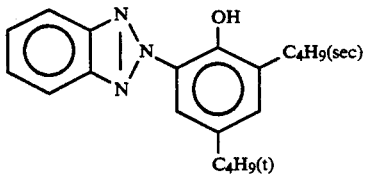
(Cpd-7) Color image stabilizer
$$\left(CH_2-\underset{\underset{CONHC_4H_9(t)}{|}}{CH}\right)_n$$
average molecular weight: 60,000
(Cpd-8) Color image stabilizer
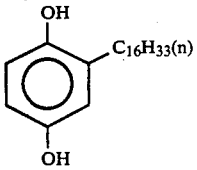
(Cpd-9) Color image stabilizer
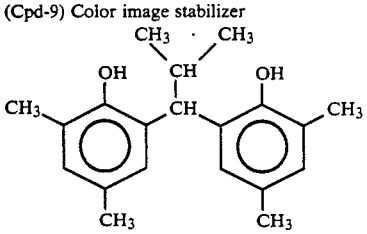
(UV-1) Ultraviolet absorbent
4:2:4 (by weight) mixture of (1), (2) and (3):
(1)
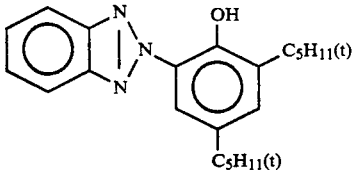
(2)
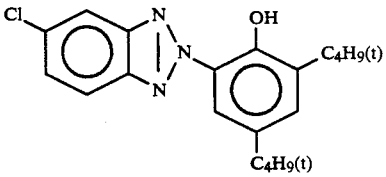
(3)
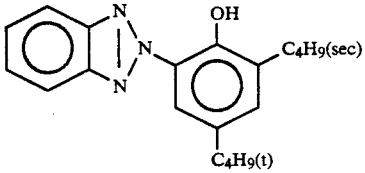
(Solv-1) Solvent -continued

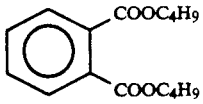

(Solv-2) Solvent
2:1 (by volume) mixture of

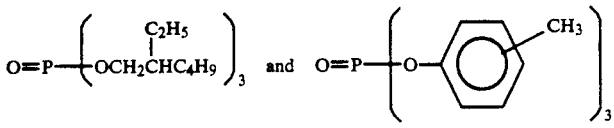

(Solv-3) Solvent
$O{=}P{\leftarrow}OC_9H_{19}(iso))_3$ (Solv-4) Solvent

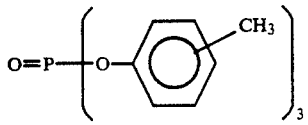

(Solv-5) Solvent

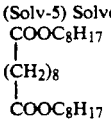

(Solv-6) Solvent

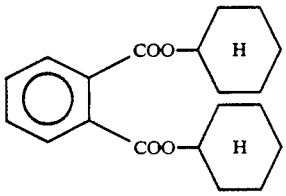

(Solv-7) Solvent (An epoxy compound for comparison)

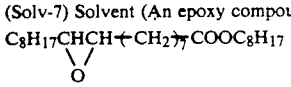

(Solv-8) Solvent (An epoxy compound for comparison)

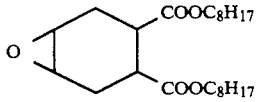

(Solv-9) Solvent (An epoxy compound for comparison)

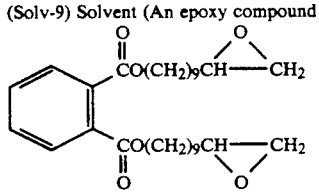

As other samples for comparison, color photographic papers, Samples 1B to 1E, IR and 1S, were prepared so as to have the same constitution as that of Sample 1A, except that the solvent (Solv-1) used in the first layer (blue-sensitive layer) was replaced in a prescribed proportion by some of the epoxy compounds set forth in Table 4 and/or the yellow coupler (ExY) used in the first layer (blue-sensitive layer) was replaced by some of the present yellow couplers set forth in Table 4.

As samples according to the present invention, color photographic papers, Samples 1F to 1Q, were prepared so as to have the same constitution as that of Sample 1A, except that the solvent (Solv-1) used in the first layer (blue-sensitive layer) was replaced in a prescribed proportion by some of the present epoxy compounds set forth in Table 4 and the yellow coupler (ExY) used in the first layer (blue-sensitive layer) was replaced by some of the present yellow couplers set forth in Table 4.

TABLE 4

| Color Photographic Paper | Epoxy Compound | Rate* of substitution for Solv-1 | Yellow coupler |
|---|---|---|---|
| 1A (comparison) | — | — | ExY |
| 1B (comparison) | Solv-7 | 100 | ExY |
| 1C (comparison) | Solv-8 | 100 | Y-2 |
| 1D (comparison) | A-20 | 100 | ExY |
| 1E (comparison) | — | — | Y-15 |
| 1F (comparison) | A-18 | 100 | Y-2 |
| 1G (comparison) | A-18 | 100 | Y-13 |
| 1H (invention) | A-18 | 50 | Y-2 |
| 1I (invention) | A-18 | 50 | Y-13 |
| 1J (invention) | A-20 | 100 | Y-15 |
| 1K (invention) | A-20 | 50 | Y-15 |
| 1L (invention) | A-26 | 100 | Y-2 |
| 1M (invention) | A-24 | 100 | Y-13 |
| 1N (invention) | A-34 | 100 | Y-2 |
| 1O (invention) | A-35 | 100 | Y-15 |
| 1P (invention) | A-47 | 100 | Y-2 |
| 1Q (invention) | A-48 | 100 | Y-13 |
| 1R (comparison) | Solv-9 | 100 | ExY |
| 1S (comparison) | Solv-9 | 100 | Y-15 |

* % by weight

Each of the thus prepared samples was subjected to wedgewise exposure through separation filters for sensitometry by using a sensitometer (Model FWH, produced by Fuji Photo Film Co., Ltd., with a light source having a color temperature of 3200° K.). Therein, the exposure time was 0.1 second and the amount of exposure was adjusted to 250 CMS.

The thus exposed samples were each processed with a paper processing machine working in accordance with the following processing steps after said photographic processing was performed continuously until the total amount of the replenisher used for color development became twice the volume of a color developing tank (running processing).

| Processing Step | Temperature | Time | Amount replenished* | Tank Volume |
|---|---|---|---|---|
| Color Development | 35° C. | 45 sec. | 161 ml | 17 l |
| Bleach-Fix | 30–35° C. | 45 sec. | 215 ml | 17 l |
| Rinsing (1) | 30–35° C. | 20 sec. | — | 10 l |
| Rinsing (2) | 30–35° C. | 20 sec. | — | 10 l |
| Rinsing (3) | 30–35° C. | 20 sec. | 350 ml | 10 l |
| Drying | 70–80° C. | 60 sec. | | |

*per $m^2$ of sensitive material.

(The rinsing was carried out according to the 3-stage countercurrent process from the step (3) to the step (1).)

The composition of each processing solution is described below.

| | Tank Soln. | Replenisher |
|---|---|---|
| Color Developer: | | |
| Water | 800 ml | 800 mml |
| Ethylenediamine-N,N,N',N'-tetramethylene phosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-ethyl-N-(β-methanesulfonamidoethyl)-3-methyl-4-aminoaniline sulfate | 5.0 g | 7.0 g |
| N,N-bis(carboxymethyl)hydrazine | 5.5 g | 7.0 g |
| Brightening agent (WHITEX 4B, products of Sumitomo Chemical Industry Co., Ltd.) | 1.0 g | 2.0 g |
| Water to make | 1000 ml | 1000 mml |
| pH (25° C.) adjusted to | 10.05 | 10.45 |
| Bleach-Fix Bath (Tank Solution = Replenisher): | | |
| Water | 400 ml | |
| Ammonium thiosulfate (70%) | 100 ml | |
| Sodium sulfite | 17 g | |
| Ammonium ethylenediaminetetraacetonatoferrate(III) | 55 g | |
| Disodium ethylenediaminetetraacetate | 5 g | |
| Ammonium bromide | 40 g | |
| Water to make | 1000 ml | |
| pH (25° C.) adjusted to | 6.0 | |

Rinsing Solution (Tank solution=Replenisher)

Ion exchange water (concentrations of calcium and magnesium ions each were below 3 ppm).

Other pieces of the photographic paper samples, which had been processed in the same manner as described above, were further allowed to stand for 8 days under a condition of 80° C.–70% RH. Then, the resulting samples were examined for decrement of the yellow density in the yellow image area with an initial density of 2.0 and increment of the magenta density therein. Thereby, the yellow dye image formed in each sample was tested for fastness to moisture and heat and for magenta color stain. The results obtained are shown in Table 5.

TABLE 5

| Color Photographic Paper | Fastness to Moisture and Heat* 80° C., 70% RH, 8 days | Magent Color Stain** 80° C., 70% RH, 8 days |
|---|---|---|
| 1A (comparison) | 0.13 | 0.11 |
| 1B (comparison) | 0.10 | 0.09 |
| 1C (comparison) | 0.11 | 0.09 |
| 1D (comparison) | 0.09 | 0.09 |
| 1E (comparison) | 0.16 | 0.10 |
| 1F (invention) | 0.07 | 0.05 |
| 1G (invention) | 0.06 | 0.06 |
| 1H (invention) | 0.06 | 0.04 |
| 1I (invention) | 0.05 | 0.03 |
| 1J (invention) | 0.07 | 0.04 |
| 1K (invention) | 0.06 | 0.04 |
| 1L (invention) | 0.09 | 0.06 |
| 1M (invention) | 0.06 | 0.05 |
| 1N (invention) | 0.08 | 0.04 |
| 1O (invention) | 0.07 | 0.05 |
| 1P (invention) | 0.07 | 0.06 |
| 1Q (invention) | 0.05 | 0.06 |
| 1R (comparison) | 0.10 | 0.10 |
| 1S (comparison) | 0.12 | 0.10 |

*Decrement of yellow density in yellow image area with initial density of 2.0
**Increment of magenta density upon storage in atmosphere with high temperature and high humidity As can be seen from the data in Table 5, the yellow dye images formed in the color photographic papers from 1F to 1Q, which each used one of the present epoxy compounds and one of the present yellow couplers, were superior to the samples from 1A to 1E, 1R and 1S (for comparison) in fastness to moisture and heat and, what is more, the present photographic papers succeeded in inhibiting magenta color stain from increasing due to moisture and heat in the yellow image area.

EXAMPLE 2

The surface of a paper support laminated with polyethylene on both sides was subjected to corona discharge, and then provided with a gelatin subbing layer in which sodium dodecylbenzenesulfonate was incorporated. Thereon, various constituent layers described below were further coated to prepare a multilayer color photographic paper(Sample 2A). Coating solutions used were prepared in the manner described below.

Preparation of Coating Solution for First Layer

An emulsified dispersion A was prepared by dissolving 153.0 g of a yellow coupler (ExY-2), 15.0 g of a color image stabilizer (Cpd-7) and 7.5 g of a color image stabilizer (Cpd-9) into a mixture of 25 g of a solvent (Solv-1), 25 g of a solvent (Solv-3) and 180 ml of ethyl acetate, and then dispersing the resulting solution in an emulsified condition into 1,000 ml of a 10% aqueous gelatin solution containing 60 ml of a 10% solution of sodium dodecylbenzenesulfonate and 10 g of citric acid. On the other hand, there were prepared two kinds of silver chlorobromide emulsions, one of which had a cubic crystal shape, an average grain size of 0.88 μm and a variation coefficient of 0.08 with respect to grain size distribution, the other of which had a cubic crystal shape, an average grain size of 0.70 μm and a variation coefficient of 0.10 with respect to grain size distribution, and both of which contained 0.3 mol% of silver bromide in a condition such that the bromide was localized in part of the grain surface). Blue-sensitive sensitizing dyes A and B illustrated below were each added to the emulsion of large grain size in the amount of $2.0\times10^{-4}$ mole/mole Ag and to the emulsion of small grain size in the amount of $2.5\times10^{-4}$ mole/mole Ag. Then, the large-sized emulsion and the small-sized emulsion were mixed in a ratio of 3:7 on a silver basis to prepare a silver chlorobromide emulsion A. Further, the emulsion A was chemically ripened by adding thereto sulfur and gold sensitizers. The resulting emulsion A was mixed homogeneously with the foregoing emulsified dispersion A, and thereto were added other ingredients described below so as to obtain the coating solution for the first layer having the composition described below.

Coating solutions for from the second to seventh layers were prepared respectively in the same manner as that for the first layer. In each layer, sodium salt of 1-oxy-3,5-dichloro-s-triazine was used as gelatin hardener.

In addition, the following compounds (Cpd-16) and (Cpd-17) were added to all of the coating solutions in the total amounts of 25.0 mg/m$^2$ and 50 mg/m$^2$, respectively.

Spectral sensitizing dyes illustrated below were added to silver chlorobromide emulsions used for the corresponding light-sensitive emulsion layers.

Blue-Sensitive Emulsion Layer

Sensitizing Dye A

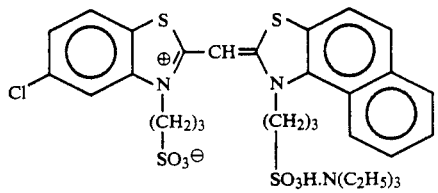

Sensitizing Dye B

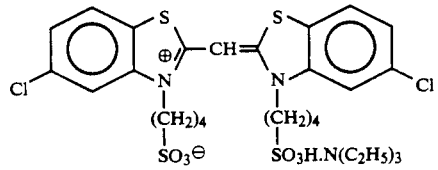

(which were each added to the emulsion of large grain size in the amount of $2.0\times10^{-4}$ mole/mole Ag and to the emulsion of small grain size in the amount of $2.5\times10^{-4}$ mole/mole Ag)

Green-Sensitive Emulsion Layer

Sensitizing Dye C

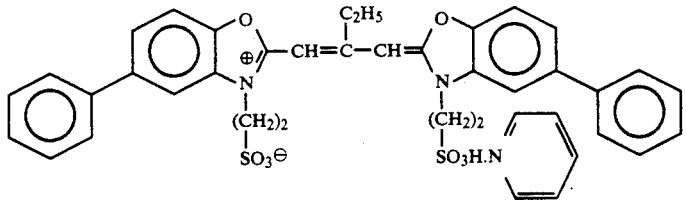

(which was added to the emulsion of large grain size in the amount of $4.0\times10^{-4}$ mole/mole Ag and to the emulsion of small grain size in the amount of $5.6\times10^{-4}$ mole/mole Ag)

Sensitizing Dye D

-continued

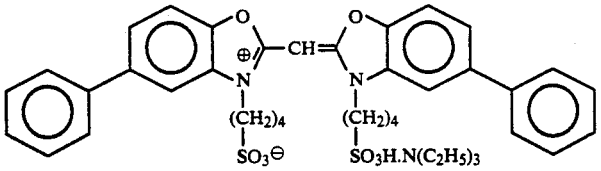

(which was added to the emulsion of large grain size in the amount of $7.0 \times 10^{-5}$ mole/mole Ag and to the emulsion of small grain size in the amount of $1.0 \times 10^{-5}$ mole/mole Ag)

Red-Sensitive Emulsion Layer

Sensitizing dye E

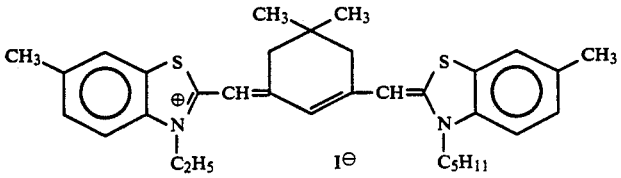

(which was added to the emulsion of large grain size in the amount of $0.9 \times 10^{-4}$ mole/mole Ag and to the emulsion of small grain size in the amount of $1.1 \times 10^{-4}$ mole/mole Ag)

The compound illustrated below was further added in the amount $2.6 \times 10^{-3}$ mole/mole Ag.

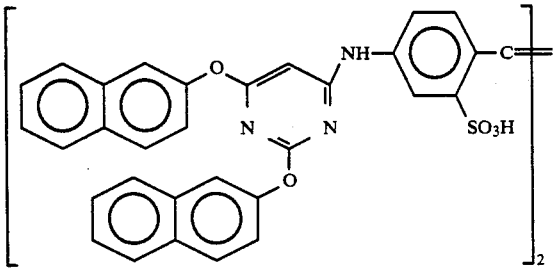

Further, 1-(5-methylureidophenyl)-5-mercaptotetrazole was incorporated into the blue-sensitive, the green-sensitive and the red-sensitive emulsion layers in the amounts of $8.5 \times 10^{-5}$ mole/mole Ag, $7.7 \times 10^{-4}$ mole/mole Ag and $2.5 \times 10^{-4}$ mole/mole Ag, respectively.

Furthermore, 4-hydroxy-6-methyl-1,3,3a,7-tetrazaindene was incorporated into the blue-sensitive and the green-sensitive emulsion layers in the amounts of $1 \times 10^{-4}$ mole/mole Ag and $2 \times 10^{-4}$ mole/mole Ag, respectively.

In addition, the dyes illustrated below (wherein each figure in parentheses represents the coverage thereof) were incorporated in the emulsion layers in order to prevent the irradiation phenomenon.

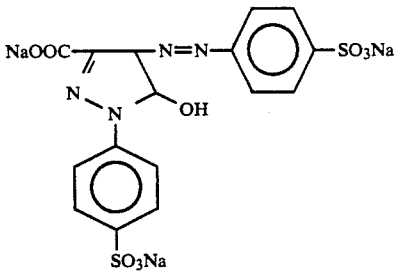

(10 mg/m²)

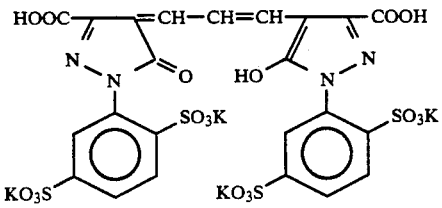

(10 mg/m²)

-continued

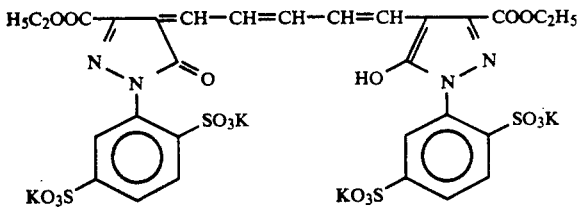

(40 mg/m²)

and

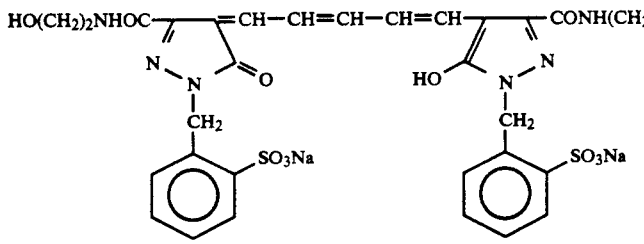

(20 mg/m²)

The composition of each constituent layer is described below. Each figure on the right side represents a coverage (g/m²) of the ingredient corresponding thereto. As for the silver halide emulsion, the figure represents a coverage based on silver.

| | |
|---|---|
| Support: | |
| Polyethylene-laminated paper [which contained white pigment ($TiO_2$) and a bluish dye (ultramarine) in the polyethylene laminated on the side of the first layer] | |
| First layer (blue-sensitive emulsion layer): | |
| Silver chlorobromide emulsion A describe above | 0.30 |
| Gelatin | 1.36 |
| Yellow Coupler (ExY-2) | 0.82 |
| Color image stabilizer (Cpd-7) | 0.08 |
| Color image stabilizer (Cpd-9) | 0.04 |
| Solvent (Solv-1) | 0.18 |
| Solvent (Solv-3) | 0.18 |
| Second Layer (color stain inhibiting layer): | |
| Gelatin | 1.00 |
| Color stain inhibitor (Cpd-3) | 0.06 |
| Solvent (Solv-12) | 0.03 |
| Solvent (Solv-1) | 0.25 |
| Solvent (Solv-4) | 0.25 |
| Third layer (green-sensitive emulsion layer): | |
| Silver chlorobromide emulsion [1:3 (by mole based on Ag) mixture of a large-sized emulsion B having a cubic crystal shape, an average grain size of 0.55 μm and a variation coefficient of 0.10 with respect to size distribution and a small-sized emulsion B having a cubic crystal shape, an average grain size of 0.39 μm and a variation coefficient of 0.08 with respect to size distribution, which both contained 0.8 mol % of AgBr localized in part of the grain surface] | 0.13 |
| Gelatin | 1.45 |
| Magenta coupler (ExM-2) | 0.16 |
| Color image stabilizer (Cpd-3) | 0.15 |
| Color image stabilizer (Cpd-9) | 0.03 |
| Color image stabilizer (Cpd-10) | 0.01 |
| Color image stabilizer (Cpd-4) | 0.01 |
| Color image stabilizer (Cpd-2) | 0.08 |
| Solvent (Solv-4) | 0.50 |
| Solvent (Solv-10) | 0.15 |
| Solvent (Solv-11) | 0.15 |
| Fourth layer (color stain inhibiting layer): | |
| Gelatin | 0.70 |
| Color stain inhibitor (Cpd-5) | 0.04 |
| Solvent (Solv-12) | 0.02 |
| Solvent (Solv-1) | 0.18 |
| Solvent (Solv-4) | 0.18 |
| Fifth layer (red-sensitive emulsion layer): | |

-continued

| | |
|---|---|
| Silver chlorobromide emulsion [1:4 (by mole based on Ag) mixture of a large-sized emulsion C having a cubic crystal shape, an average grain size of 0.50 μm and a variation coefficient of 0.09 with respect to size distribution and a small-sized emulsion C having a cubic crystal shape, an average grain size of 0.41 μm and a variation coefficient of 0.11 with respect to size distribution, which both contained 0.8 mol % of AgBr localized in part of the grain surface] | 0.20 |
| Gelatin | 0.85 |
| Cyan coupler (ExC-2) | 0.33 |
| Ultraviolet absorbent (UV-3) | 0.18 |
| Color image stabilizer (Cpd-11) | 0.15 |
| Color image stabilizer (Cpd-12) | 0.15 |
| Color image stabilizer (Cpd-13) | 0.01 |
| Solvent (Solv-6) | 0.22 |
| Color image stabilizer (Cpd-2) | 0.01 |
| Color image stabilizer (Cpd-10) | 0.01 |
| Color image stabilizer (Cpd-1) | 0.35 |
| Solvent (Solv-7) | 0.01 |
| Sixth layer (ultraviolet absorbing layer): | |
| Gelatin | 0.55 |
| Ultraviolet absorbent (UV-2) | 0.38 |
| Color image stabilizer (Cpd-14) | 0.15 |
| Color image stabilizer (Cpd-3) | 0.02 |
| Seventh layer (protective layer): | |
| Gelatin | 1.13 |
| Acryl-modified polyvinyl alcohol copolymer (modification degree: 17%) | 0.05 |
| Liquid paraffin | 0.02 |
| Color image stabilizer (Cpd-15) | 0.01 |

(ExY-2) Yellow Coupler

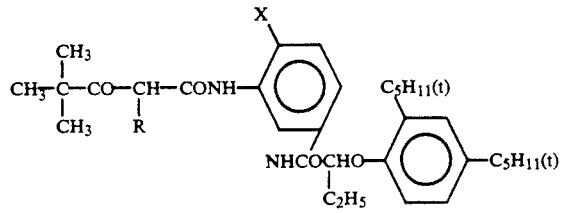

1:1 (by mole) mixture of that containing

-continued

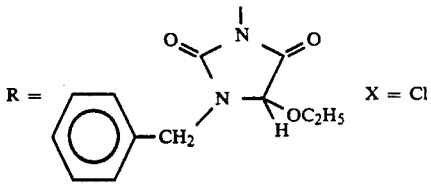

with that containing

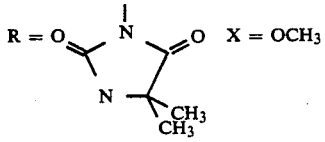

(ExM-2) Magenta Coupler

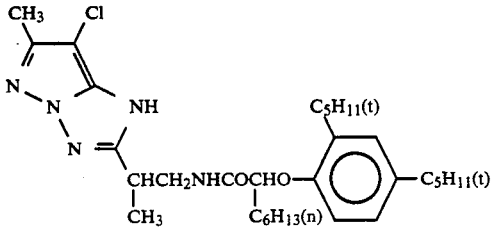

(ExC-2) Cyan Coupler

3:7 (by mole) mixture of

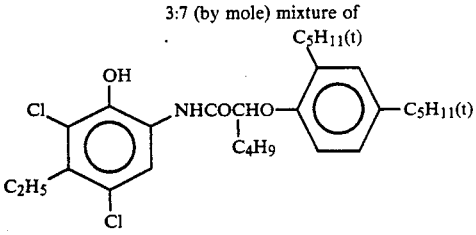

and

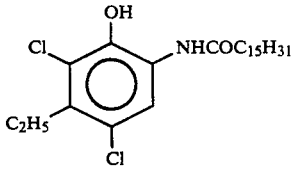

(Cpd-10) Color Image Stabilizer

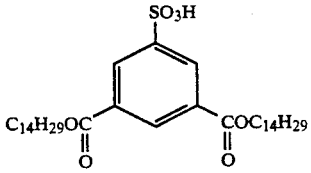

(Cpd-11) Color Image Stabilizer

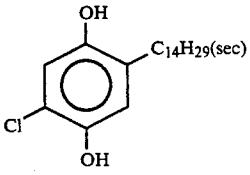

(Cpd-12) Color Image Stabilizer

-continued

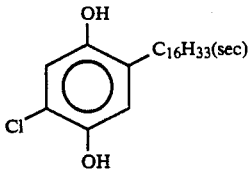

(Cpd-13) Color Image Stabilizer

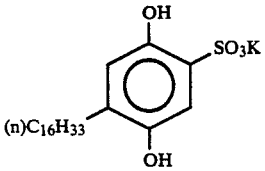

(Cpd-14) Color Image Stabilizer

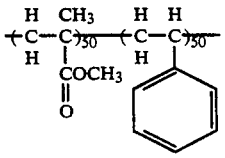

average molecular weight: 60,000

(Cpd-15) Color Image Stabilizer

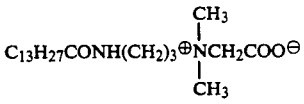

(Cpd-16) Antiseptic

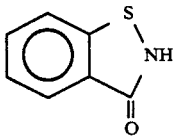

(Cpd-17) Antiseptic

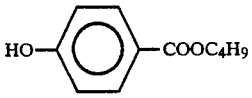

(UV-2) Ultraviolet Absorbent

10:5:1:5 (by weight) mixture of (1), (2), (3) and (4):

(1)

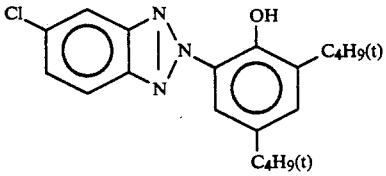

(2)

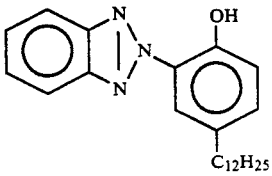

-continued

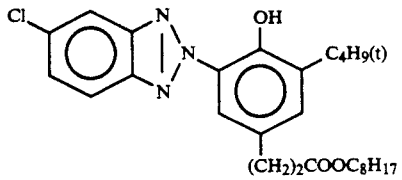

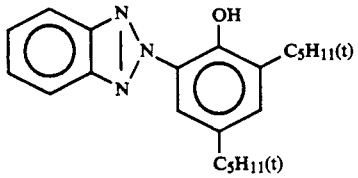

(UV-3) Ultraviolet Absorbent

1:2:2 (by weight) mixture of (1), (2) and (3):

(1)

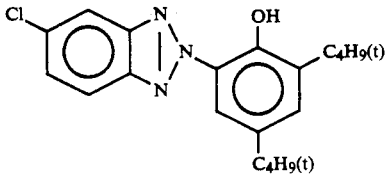

(2)

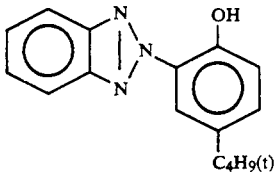

(3)

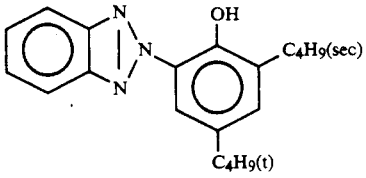

-continued (3) (Solv-10) Solvent

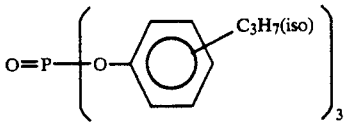

(4) (Solv-11) Solvent

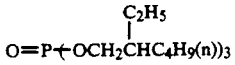

(Solv-12) Solvent

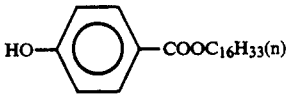

Color photographic papers according to the present invention, Samples 2F to 2Q, were prepared in the same manner as Sample 2A, except that as shown in Table 6 the present yellow couplers were used in place of the yellow coupler (ExY-2), those to which a preference was given among the present magenta couplers were used in place of the magenta coupler (ExM-2) and the present epoxy compounds were added to any one of the constituent layers. In addition, Samples 2B to 2E were prepared as shown in Table 6 in order to compare with the color photographic papers of the present invention. Each of these samples was exposed and processed in the same manner as in Example 1, and then allowed to stand for 16 days under a condition of 80° C.-70% RH. Th resulting samples were each examined for decrement of the yellow density in the yellow image area with an initial density of 2.0 and increment of the magenta density therein. Thereby, the yellow dye image formed in each sample was tested for fastness to moisture and heat and for magenta color stain. The results obtained are shown in Table 7.

TABLE 6

| Color Photographic paper | 1st Layer (blue-sensitive layer) Yellow Coupler | Coverage ($g/m^2$) | 3rd Layer (green-sensitive layer) Magenta Coupler | Epoxy Compound added Layer Layer Name | Compound No. | Coverage ($g/m^2$) |
|---|---|---|---|---|---|---|
| 2A (comparison) | ExY-2 | 0.62 | ExM-2 | — | — | — |
| 2B (comparison) | ExY-2 | 0.62 | M-24 | — | — | — |
| 2C (comparison) | ExY-2 | 0.62 | ExM-2 | 1st | A-18 | 0.08 |
| | | | | 3rd | A-18 | 0.08 |
| 2D (comparison) | Y-2 | 0.50 | ExM-2 | — | — | — |
| 2E (comparison) | Y-13 | 0.50 | M-24 | — | — | — |
| 2F (invention) | Y-2 | 0.50 | M-1 | 1st | A-18 | 0.16 |
| 2G (invention) | Y-2 | 0.50 | M-10 | 1st | A-47 | 0.16 |
| 2H (invention) | Y-2 | 0.50 | M-10 | 1st | A-18 | 0.08 |
| | | | | 2nd | A-18 | 0.08 |
| 21 (invention) | Y-2 | 0.50 | M-24 | 1st | A-21 | 0.08 |
| | | | | 3rd | A-21 | 0.08 |
| 2J (invention) | Y-2 | 0.50 | M-25 | 1st | A-20 | 0.08 |
| | | | | 3rd | A-20 | 0.08 |
| 2K (invention) | Y-13 | 0.50 | M-10 | 1st | A-18 | 0.08 |
| | | | | 3rd | A-18 | 0.08 |
| 2L (invention) | Y-13 | 0.50 | M-24 | 1st | A-35 | 0.16 |
| 2M (invention) | Y-13 | 0.50 | M-32 | 1st | A-34 | 0.08 |
| | | | | 2nd | A-34 | 0.08 |
| 2N (invention) | Y-15 | 0.50 | M-1 | 1st | A-24 | 0.16 |
| 20 (invention) | Y-15 | 0.50 | M-10 | 1st | A-48 | 0.08 |
| | | | | 3rd | A-48 | 0.08 |
| 2P (invention) | Y-15 | 0.50 | M-25 | 1st | A-21 | 0.08 |
| | | | | 2nd | A-21 | 0.08 |
| 2Q (invention) | Y-15 | 0.50 | M-32 | 1st | A-18 | 0.08 |

TABLE 6-continued

| Color Photographic paper | 1st Layer (blue-sensitive layer) Yellow Coupler | Coverage ($g/m^2$) | 3rd Layer (green-sensitive layer) Magenta Coupler | Epoxy Compound added Layer Layer Name | Compound No. | Coverage ($g/m^2$) |
|---|---|---|---|---|---|---|
| | | | | 4th | A-18 | 0.08 |

TABLE 7

| Color Photographic Paper | Fastness to Moisture and Heat* 80° C., 70% RH, 16 days | Magent Color Stain** 80° C., 70% RH, 16 days |
|---|---|---|
| 2A (comparison) | 0.26 | 0.25 |
| 2B (comparison) | 0.26 | 0.20 |
| 2C (comparison) | 0.16 | 0.18 |
| 2D (comparison) | 0.30 | 0.28 |
| 2E (comparison) | 0.31 | 0.23 |
| 2F (invention) | 0.18 | 0.12 |
| 2G (invention) | 0.18 | 0.13 |
| 2H (invention) | 0.17 | 0.11 |
| 2I (invention) | 0.16 | 0.13 |
| 2J (invention) | 0.14 | 0.13 |
| 2K (invention) | 0.14 | 0.12 |
| 2L (invention) | 0.16 | 0.14 |
| 2M (invention) | 0.12 | 0.10 |
| 2N (invention) | 0.14 | 0.14 |
| 2O (invention) | 0.13 | 0.12 |
| 2P (invention) | 0.13 | 0.11 |
| 2Q (invention) | 0.12 | 0.13 |

*Decrement of yellow density in yellow image area with initial density of 2.0
**Increment of magenta density upon storage in atmosphere with high temperature and high humidity As can be seen from the data in Table 7, the yellow dye images formed in the photographic papers from 2F to 2Q, which each used one of the present epoxy compounds, one of the present yellow couplers and one of the present magenta couplers, were superior in fastness to moisture and heat and, what is more, an increase of magenta color stain in the yellow image area due to moisture and heat was markedly depressed in the present photographic papers, compared with those for comparison.

What is claimed is:

1. A silver halide color photographic material comprising on a support a yellow coupler-containing light-sensitive silver halide emulsion layer, a magenta coupler-containing light-sensitive silver halide emulsion layer, a cyan coupler-containing light-sensitive silver halide emulsion layer and a light-insensitive hydrophilic colloid layer, said photographic material comprising (i) at least one epoxy compound which is slightly soluble in water and represented by the following general formula (AE-1), (AE-2), (AE-3) or (AE-4), (ii) an acylacetamide type yellow coupler containing the acyl group represented by the general formula (I) and (iii) a pyrazolotriazole type magenta coupler of the formula (II) or (III):

(AE-1)

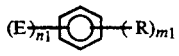

(AE-2)

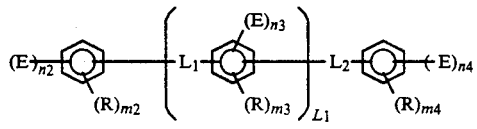

-continued (AE-3)

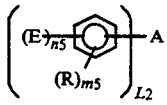

(AE-4)

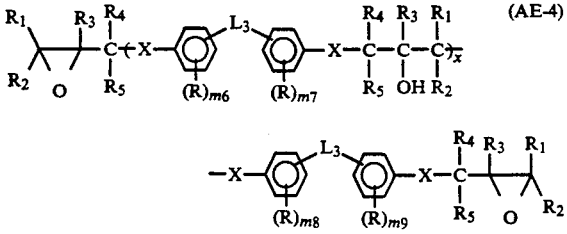

wherein E represents the following general formula (AO-2), (AO-2)

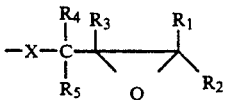

wherein $R_1$, $R_2$, $R_3$, $R_4$ and $R_5$ are same or different, and each represents a hydrogen atom, an alkyl group or an aryl group; R represents a substituent group; n represents 0 or an integer of 1 to 4; —X— represents —O—, —S— or —N($R^1$)—; $R^1$ represents a hydrogen atom, an acyl group, an alkylsulfonyl group, an arylsulfonyl group, an aryl group, a heterocyclic group or —C($R_6$)($R_7$)($R_8$), wherein $R_6$, $R_7$ and $R_8$ are same or different, and each represents an alkyl group or a group represented by the following general formula (AO-1), (AO-1)

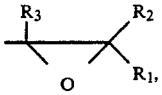

and further $R_6$ and $R_7$ each may be a hydrogen atom; when n is 2, 3 or 4, R's may be same or different; and any two of $R_1$, $R_2$, $R_3$, $R_4$ and $R_5$, R' and R, or two R's may combine with each other to complete a 5-to 7-membered ring; provided that the total number of carbon atoms contained in said compound is at least 15 when X is —S—; $L_1$, $L_2$ and $L_3$ may be same or different, and each represents a divalent linkage group; $n_1$ represents an integer of 3 to 6; $m_1$ represents an integer of 0 to 3; $n_2$ represents an integer of 1 to 5; $n_3$ represents an integer of 1 to 4; $n_4$ represents an integer of 1 to 5; $m_2$ represents an integer of 0 to 4; $m_3$ represents an integer of 0 to 3; $m_4$ represents an integer of 0 to 4; $m_5$ represents an integer of 1 to 5; $m_5$ represents an integer of 0 to 4; $m_6$, $m_7$, $m_8$ and $m_9$ each represent an integer of 0 to 4; $l_1$ and x each represent a real number from 0 to 20; $l_2$ represents 3 or 4; and A represents a tri- or tetravalent organic group; and wherein when the foregoing epoxy compounds each have a plurality of E's and/or a plurality of R's, those E's may be same or different and those R's also may be same or different:

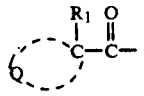

(I)

wherein $R_1$ represents a monovalent group, and Q represents nonmetallic atoms necessary to form a 3- to 5-membered hydrocarbon ring or a 3- to 5-membered heterocyclic ring which contains at least one hetero atom selected from N, O, S and P in the ring; provided that $R_1$ is neither a hydrogen atom nor atoms completing a ring combining with Q:

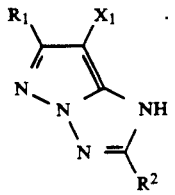

(II)

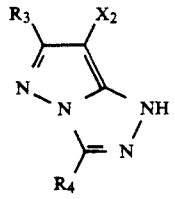

(III)

wherein $R_1$ and $R_2$ each represent an alkyl group, $R_2$ and $R_4$ each represent an alkyl group or an aryl group, and $X_1$ and $X_2$ each represent a halogen atom or an aryloxy group.

2. The silver halide color photographic material claimed in claim 1, wherein the epoxy compound has solubility of no greater than 10% in water at 25° C.

3. The silver halide color photographic material claimed in claim 1, wherein the acylacetamide type yellow coupler has the following general formula [Y]:

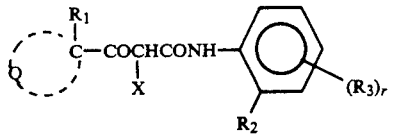

[Y]

wherein $R_1$ and Q have the same meanings as those in the general formula (I), respectively; $R_2$ represents a hydrogen atom, a halogen atom, an alkoxy group, an aryloxy group, an alkyl group or an amino group; $R_3$ represents a substituent for a benzene ring; X represents a hydrogen atom, or a splitable group by the coupling reaction with an oxidation product of an aromatic primary amine developing agent; and r represents an integer of 0 to 4, wherein when r is a plural number, $R_3$'s may be same or different.

4. The silver halide color photographic material claimed in claim 1, wherein at least one of $R_2$ and $R_4$ of the pyrazolotriazole type magenta coupler represented by the general formula (II) or (III) is a substituted or unsubstituted straight-chain or branched alkyl group having 1 to 10 carbon atoms or a substituted phenyl group.

5. The silver halide color photographic material claimed in claim 1, wherein $R_2$ in formula (II) is a substituted alkyl group having one or no hydrogen atom on the carbon atom attached to the pyrazolotriazole skeleton or a substituted phenyl group having at least one acylamino or sulfonamido group.

6. The silver halide color photographic material claimed in claim 1, wherein $R_4$ in formula (III) is a substituted alkyl group containing at least two carbon atoms, a substituted alkyl group having one or no hydrogen atom on the carbon atom attached to the pyrazolotriazole skeleton, or a substituted phenyl group having at least one substituent at the o-position with respect to the carbon atom attached to the pyrazolotriazole skeleton.

7. The silver halide color photographic material claimed in claim 1, wherein $R_2$ in formula (II) is a substituted alkyl group of the formula, $-CH(CH_3)CH_2NHR_5$ or $-C(CH_3)_2CH_2NHR_5$, wherein $R_5$ represents an aliphatic or aromatic, acyl or sulfonyl group, or a substituted phenyl group having an acylamino or sulfonamido group at the m- or p-position with respect to the carbon atom attached to the pyrazolotriazole skeleton.

8. The silver halide color photographic material claimed in claim 1, wherein $R_4$ in formula (III) is a substituted alkyl group of the formula, $-(CH_2)_n-SO_2R_6$, wherein n is an integer of at least 2 and $R_6$ represents an unsubstituted straight-chain or branched alkyl group or a substituted phenyl group, $-CH(CH_3)-NHR_7$, $-C(CH_3)_2NHR_7$, $-CH(CH_3)CH_2NHR_7$ or $-C(CH_3)_2CH_2NHR_7$, wherein $R_7$ has the same meaning as $R_5$, or a phenyl group having alkyl groups at both the o-positions with respect to the carbon atom attached to the pyrazolotriazole skeleton and further having at least one acylamino or sulfonamido group at the m- or p-position.

9. The silver halide color photographic material claimed in claim 1, wherein $X_1$ or $X_2$ of the pyrazolotriazole type magenta coupler represented by the general formula (II) or (III) is a chlorine atom or a phenoxy group having at the p-position a substituted or unsubstituted alkyl, alkoxycarbonyl or sulfonyl group.

10. The silver halide color photographic material claimed in claim 1, wherein the epoxy compound is incorporated in at least one of the yellow coupler containing layer, the magenta coupler containing layer and an interlayer disposed therebetween.

11. The silver halide color photographic material claimed in claim 10, wherein the epoxy compound is contained in the yellow coupler containing layer.

12. The silver halide color photographic material claimed in claim 10, wherein the epoxy compound is used in a proportion of 3 to 100% by weight to a yellow coupler incorporated in the silver halide color photographic material.

13. The silver halide color photographic material claimed in claim 3, wherein the yellow coupler of the formula is incorporated in a blue-sensitive emulsion layer or a light-insensitive layer adjacent thereto.

14. The silver halide color photographic material claimed in claim 3, wherein the coverage of the yellow coupler is from 0.05 to 5.0 mmol/$m^2$.

15. The silver halide color photographic material of claim 1, wherein the epoxy compound has at least two benzene rings.

16. The silver halide color photographic material of claim 1, wherein the epoxy compound contains at least 9 total carbon atoms.

17. The silver halide color photographic material of claim 1, wherein —X— of the formula (AO-2) represented by E in general formula (AE-2) is —O—, $l_1$ is a real number of 1 to 20, $n_2$ or $n_4$ is 1 or 2, $m_2$, $m_3$ or $m_4$ is an integer of 0 to 3, and R is an alkyl group, a halogen atom or an alkoxy group.

18. The silver halide color photographic material of claim 1, wherein $R_1$ or $R_3$ of the formula (II) or (III) is an isopropyl group or a t-butyl group.

19. The silver halide color photographic material of claim 1, wherein at least one of the light-sensitive silver halide emulsion layers contains silver halide grains selected from silver chloride grains and silver chlorobromide grains substantially free from silver iodide and having a silver chloride content of no less than 90 mol %.

* * * * *